US007942084B2

(12) United States Patent
Wilson, Jr. et al.

(10) Patent No.: US 7,942,084 B2
(45) Date of Patent: May 17, 2011

(54) POWERED DRIVER AND METHODS FOR RELIABLE REPEATED SECUREMENT OF THREADED CONNECTORS TO A CORRECT TIGHTNESS

(75) Inventors: David Wilson, Jr., Fort Collins, CO (US); Brent A. Sigmon, Windsor, CO (US)

(73) Assignee: American Power Tool Company, Boulder, CO (US)

( * ) Notice: Subject to any disclaimer, the term of this patent is extended or adjusted under 35 U.S.C. 154(b) by 252 days.

(21) Appl. No.: 12/290,029

(22) Filed: Oct. 27, 2008

(65) Prior Publication Data

US 2009/0205848 A1 Aug. 20, 2009

Related U.S. Application Data

(63) Continuation-in-part of application No. 12/004,757, filed on Dec. 21, 2007, now Pat. No. 7,513,179, which is a continuation of application No. 11/634,695, filed on Dec. 6, 2006, now Pat. No. 7,311,025.

(51) Int. Cl.
*B25B 21/00* (2006.01)
*B25B 23/147* (2006.01)

(52) U.S. Cl. ..... 81/429; 81/467; 81/57.14

(58) Field of Classification Search ..... 81/429, 81/57–57.14, 57.28–57.34, 58.2; 73/862.08, 73/862.21–862.24, 862.27, 862.29, 862.31; 173/1, 2, 216

See application file for complete search history.

(56) References Cited

U.S. PATENT DOCUMENTS

| | | | | |
|---|---|---|---|---|
| 2,854,755 | A | | 10/1958 | Knobel |
| 2,995,738 | A | | 8/1961 | Masek |
| 3,289,310 | A | | 12/1966 | Stone |
| 3,581,607 | A | | 6/1971 | Rogers |
| 3,724,964 | A | | 4/1973 | Needham, Jr. |
| 4,095,325 | A | | 6/1978 | Hashimoto et al. |
| 4,125,016 | A | * | 11/1978 | Lehoczky et al. ..... 73/862.23 |
| 4,330,052 | A | | 5/1982 | Schymick |
| 4,335,516 | A | | 6/1982 | Edelstein |
| 4,376,396 | A | | 3/1983 | Hayhoe |
| 4,909,683 | A | | 3/1990 | Kopidlowski et al. |
| 5,355,751 | A | | 10/1994 | Specht |
| 5,460,062 | A | | 10/1995 | Wilson, Jr. |
| 5,522,285 | A | | 6/1996 | Wilson, Jr. et al. |
| 5,537,897 | A | | 7/1996 | Wilson, Jr. |

(Continued)

OTHER PUBLICATIONS

U.S. Appl. No. 12/004,757, filed Jun. 2008, Wilson. Jr.

*Primary Examiner* — David B Thomas
(74) *Attorney, Agent, or Firm* — Harold A. Burdick

(57) ABSTRACT

A powered driver and methods are disclosed, the driver including a head having a gapped jaw and housing a motor driven drive transfer assembly for operating a rotatable split socket engageable at a threaded connector. A reaction unit is movably maintained through the head, and a probe is associated with the reaction unit. The methods of this invention include setting a selected rotational limitation at the driver relating to fitting characteristics, operating the driver to cause relative rotation of a connector nut located in the socket and connector body engaged by the reaction unit. One of a plurality of operational modes for driver operations is selected and relative movement of the head and reaction unit are monitored during driver operation. The driver is controlled so that driver operation ceases when a selected combination of events related to operational mode selected and at least one of rotational limitation setting, monitored relative movement or driver operation occurs.

21 Claims, 33 Drawing Sheets

U.S. PATENT DOCUMENTS 5,609,077 A 3/1997 Ohmi et al.
5,881,612 A 3/1999 McCallops
6,487,940 B2 * 12/2002 Hart et al. ..... 81/57.14
6,546,815 B2 * 4/2003 Yamada et al. ..... 73/862.21
7,311,025 B1 12/2007 Wilson, Jr.

* cited by examiner

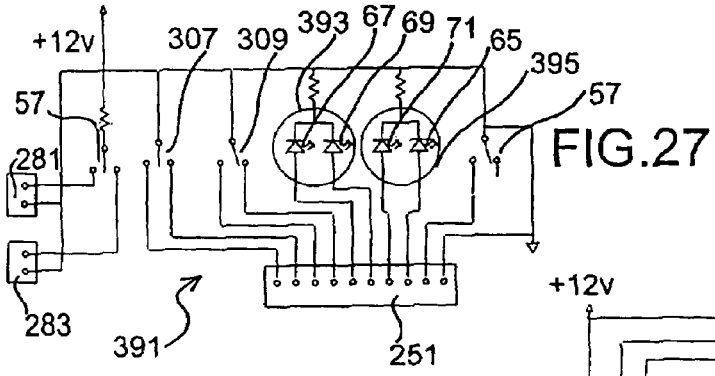
FIG.27
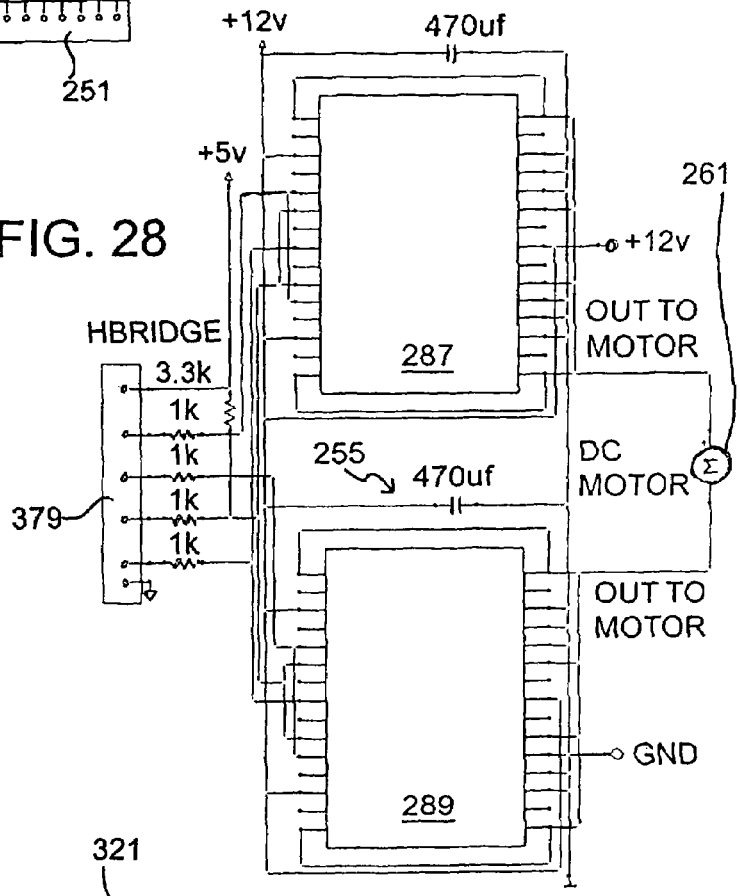
FIG. 28
FIG. 29
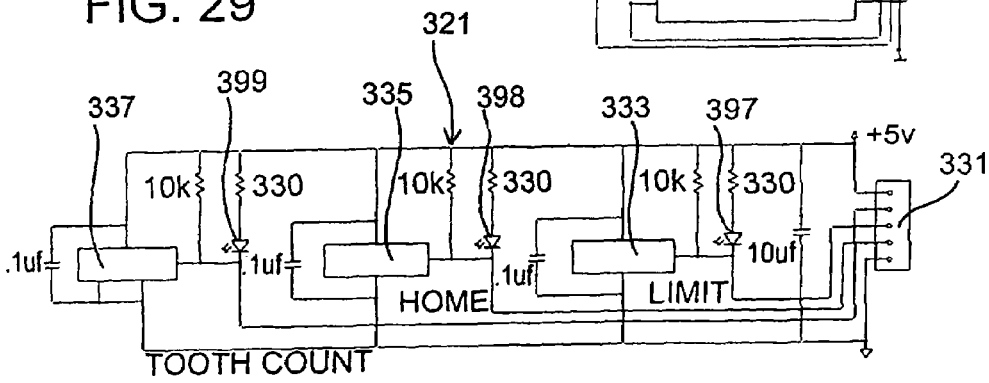

POWERED DRIVER AND METHODS FOR RELIABLE REPEATED SECUREMENT OF THREADED CONNECTORS TO A CORRECT TIGHTNESS

RELATED APPLICATION

This application is a Continuation-In-Part Application of U.S. patent application Ser. No. 12/004,757 filed Dec. 21, 2007 now U.S. Pat. No. 7,513,179 and entitled "Drive Engagement, Safety and Control Apparatus For A Powered Connector Driver", which application is a Continuation of U.S. patent application Ser. No. 11/634,695 filed on Dec. 6, 2006 entitled "Powered Driver With Location Specific Switching" (now issued as U.S. Pat. No. 7,311,025).

FIELD OF THE INVENTION

This invention relates to drivers for tools, and, more particularly, relates to powered nut drivers.

BACKGROUND OF THE INVENTION

Powered drivers, both pneumatic and electrical, for manipulation of various types of tools (such as sockets for threaded connectors) are well known. In many applications, such as manipulation of threaded line fittings (i.e., unions or the like) found in all gas or liquid processing or delivery operations and assemblies, correct tightness of the fitting is critical to assure a sound connection and to avoid leakage (which may occur if line fittings are either over or under tightened).

Numerous approaches to gauging the correct tightness of such connectors have been heretofore suggested and/or utilized, with varying degrees of success. Torque requirements for driving large and small fasteners vary such that the same driver often cannot be employed for different fasteners. Moreover, devices and methods for gauging fitting integrity during fitting installation that are used for pneumatic tools are frequently not applicable for electrical drivers and vice versa. Such heretofore known approaches are often not highly accurate and repeatable, and/or are quite expensive computer-based applications of limited utility in the field.

In certain high torque application, reaction torque can be so high that driver components seize. Mechanical driver switching, moreover, has been subject to compromise due to conditions of use (particularly related to moisture or chemical contamination). Finally, heretofore known tools have often relied on a single control technique to assure correct fitting tightness, eschewing backup means. Reliance on the driver's operator for correct fastener securement often leads to fastener failures related to operator error.

A fitting of a specific type (manufacture and/or fitting characteristics and materials) and size has remarkably similar tolerances (range of correct fitting tightness) one fitting to the next and can be manipulated similarly during securement. Tolerances for fittings of different types and sizes, likewise, should be treated differently during field application. Heretofore known drivers have not always made use of such readily quantifiable distinctions. Further improvement of such drivers and driving methods could thus still be utilized.

SUMMARY OF THE INVENTION

This invention relates to improved drivers and methods for manipulating threaded connectors that accommodate reliable repeated precise tightening of threaded connectors based on location specific switching. In particular, methods for reliable repeated securement of threaded connectors that include a nut and a body to a correct tightness utilizing a powered driver that includes a nut engaging head and an associated connector body engaging unit, the head and engaging unit movable relative to one another, are disclosed. The methods include the steps of setting a selected rotational limitation at the driver relating to fitting characteristics, engaging the nut and the body of the connector at the head and engaging unit, respectively, and then operating the driver to cause relative rotation of the nut and the body. The driver is caused to cease operating when an event related to either one of rotational limitation setting and driver operation occurs.

Related methods are provided for reliable repeatable gauging of correct tightness of threaded fittings utilizing a powered driver that includes a gear tooth surface associated with a socket for nut rotation and movement toward the fitting body during driver operation. These methods include steps for maintaining a count of teeth of the gear tooth surface passing a location at the driver during a selected interval of operation of the driver and gauging relative location of the socket and fitting body during movement toward the fitting body. The maintained count(s) and the gauging are selectively utilized to control driver operation.

The threaded fitting drivers of this invention include a driver head having a rotatable socket thereat for engaging the fitting. Means for rotating the socket are associated with the driver head, a reaction unit movable at the driver head relative to the socket and engageble with the fitting. A controller accepts user input of at least either a selected operational mode from a plurality of modes including pulse mode and swage mode or a selected socket rotational limitation, and initiates precision cessation of socket rotation in accord with the user input.

It is therefore an object of this invention to provide drivers and methods for manipulating threaded connectors that accommodate reliable repeated precise tightening of threaded connectors based on location specific switching techniques.

It is another object of this invention to provide drivers and methods for manipulating threaded connectors that recognize and react to driver malfunction and/or fitting defect.

It is still another object of this invention to provide drivers and methods for manipulating threaded connectors that utilizes non-contact driver control switching.

It is yet another object of this invention to provide powered fitting drivers and methods utilizing gauging to accommodate specific fitting tolerances.

It is still another object of this invention to provide drivers and methods for manipulating threaded connectors that includes backup driver control techniques to assure correct fitting tightness.

It is another object of this invention to provide drivers and methods for manipulating threaded connectors that reduces the likelihood of, and/or recognizes, operator error.

It is still another object of this invention to provide a method for reliable repeated securement of threaded connectors that include a nut and a body to a correct tightness utilizing a powered driver that includes a nut engaging head and an associated connector body engaging unit, the head and engaging unit movable relative to one another, the method including the steps of setting a selected rotational limitation at the driver relating to fitting characteristics, engaging the nut and the body of the connector at the head and engaging unit, respectively, operating the driver to cause relative rotation of the nut and the body, and causing the driver to cease operating when an event related to either one of rotational limitation setting and driver operation occurs.

It is yet another object of this invention to provide a driver for reliable repeated securement of threaded fittings to a correct tightness that includes a driver head, a rotatable socket at the driver head for engaging the fitting, means for rotating the socket associated with the driver head, a reaction unit at the driver head movable relative to the socket and engageble with the fitting, and control means for user input of at least one of a selected socket rotational limitation and a selected operational mode from a plurality of modes including pulse mode and swage mode, and for precision cessation of socket rotation in accord with the user input.

It is yet another object of this invention to provide a method for reliable repeatable gauging of correct tightness of threaded fittings that include a nut and a body secured utilizing a powered driver that includes a gear tooth surface associated with a nut engageable socket for nut rotation and movement toward the fitting body during driver operation, the method steps including maintaining a count of teeth of the gear tooth surface passing a location at the driver during a selected interval of operation of the driver, gauging relative location of the socket and fitting body during movement toward the fitting body, and selectively utilizing the maintained count(s) and the gauging to control driver operation.

With these and other objects in view, which will become apparent to one skilled in the art as the description proceeds, this invention resides in the novel construction, combination and arrangement of parts and methods substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 26 through 29 are schematic diagrams showing now preferred electronics of the driver of this invention and including adaptations accommodating features of the driver shown in FIG. 16.

DESCRIPTION OF THE INVENTION

Figure 1:
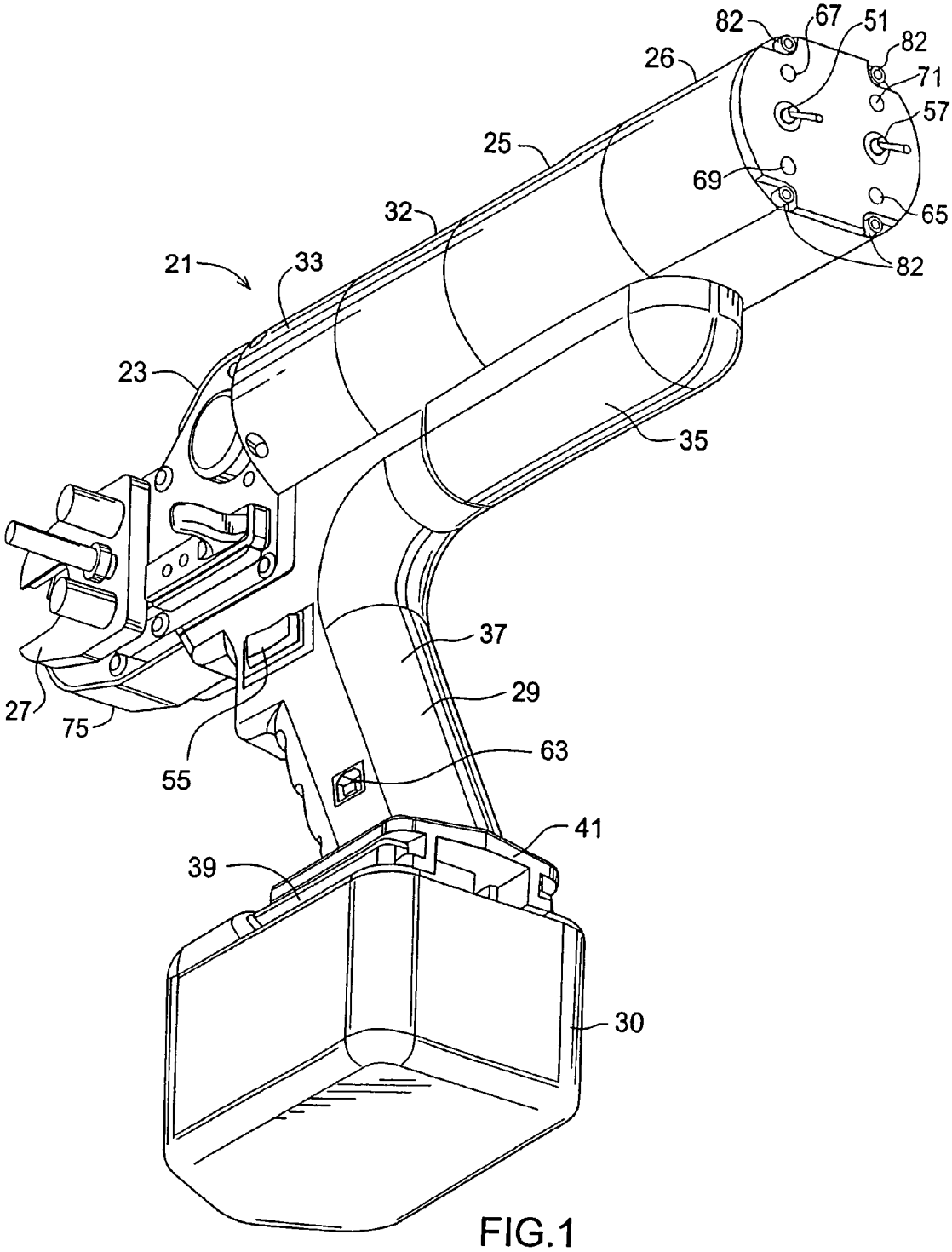
FIG. 1 is a perspective view showing the tool driver of this invention.
Figure 2:
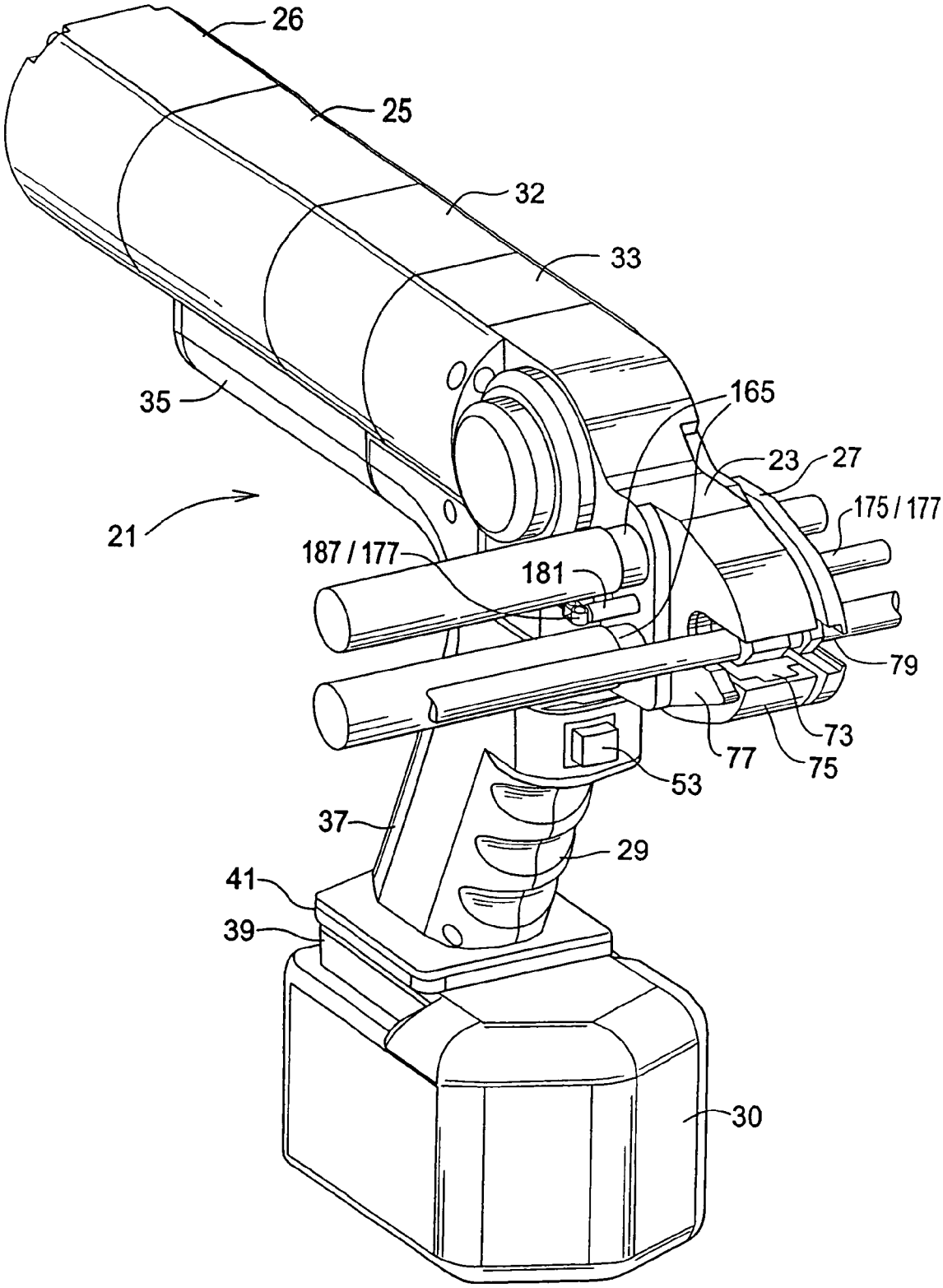
FIG. 2 is a reverse perspective view of the driver of FIG. 1.
Figure 3:
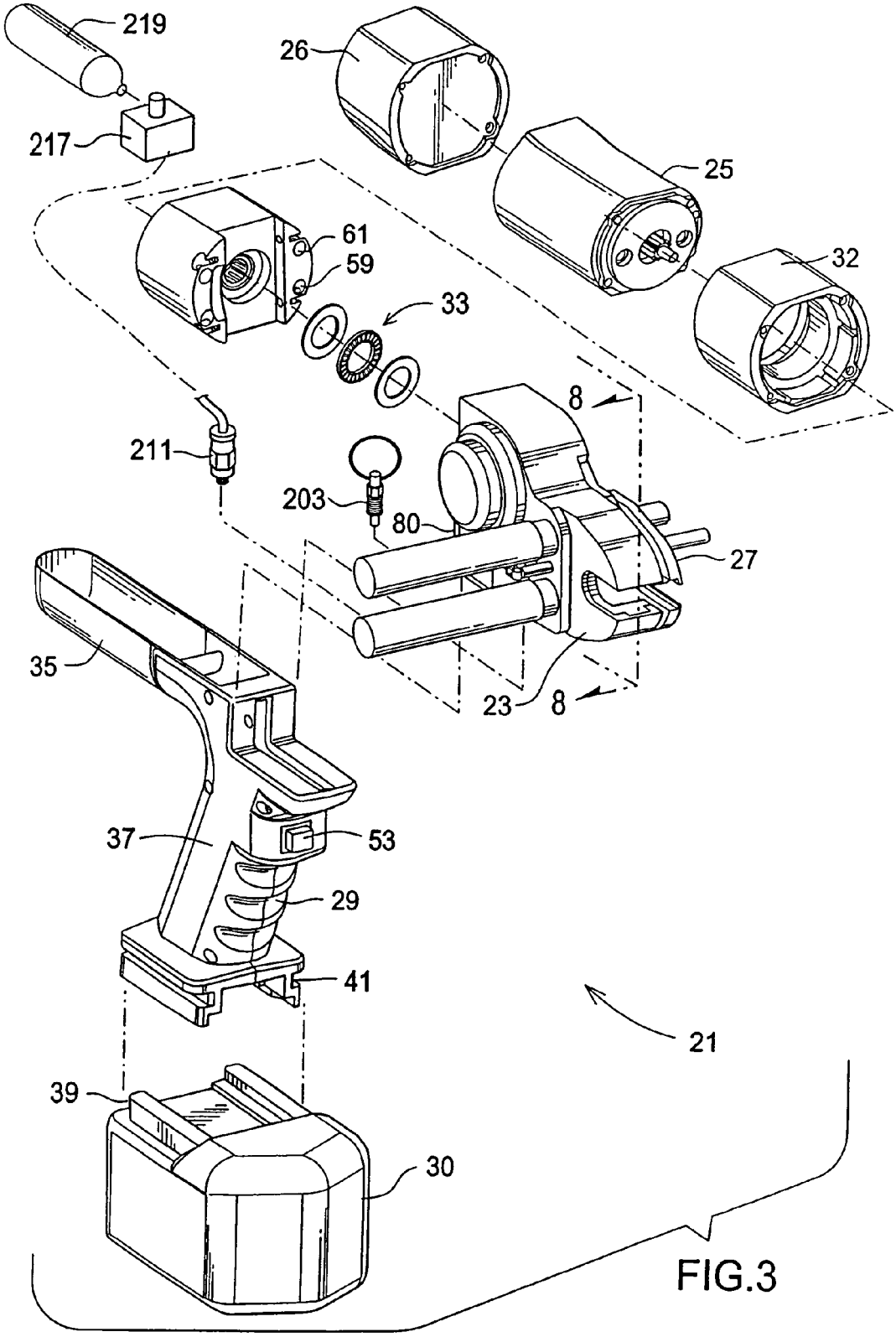
FIG. 3 is a partial exploded view of the housing and components of the driver of this invention.

Powered driver 21, for rotating tools such as sockets or the like to manipulate threaded connectors, is illustrated in FIGS. 1 through 3. Driver 21 includes driver head 23, motor module 25 (any means of applying motive force could be used including electrical, pneumatic or fluid drive motors), electronics module 26, reaction unit 27, housing 29, and battery pack 30. Torque amplification drive train modules 32 and 33 provide a drive train capable of staged increase of torque from a motor 25 rating of about 0.18 ft.lbs. to over 35 ft.lbs., thereby accommodating connector manipulation in a wide variety of size and torque application categories (torque amplification is adaptable to requirements). Housing 29 is hollow at both barrel portion 35 and handle portion 37 thus providing the required space and protection for driver electrical components as hereinafter discussed. Battery pack 30 is of standard configuration and includes a standard conductive slide connector 39 (with mating unit 41 at handle portion 35) providing both connectivity and security of batteries in pack 30.

Figure 4:
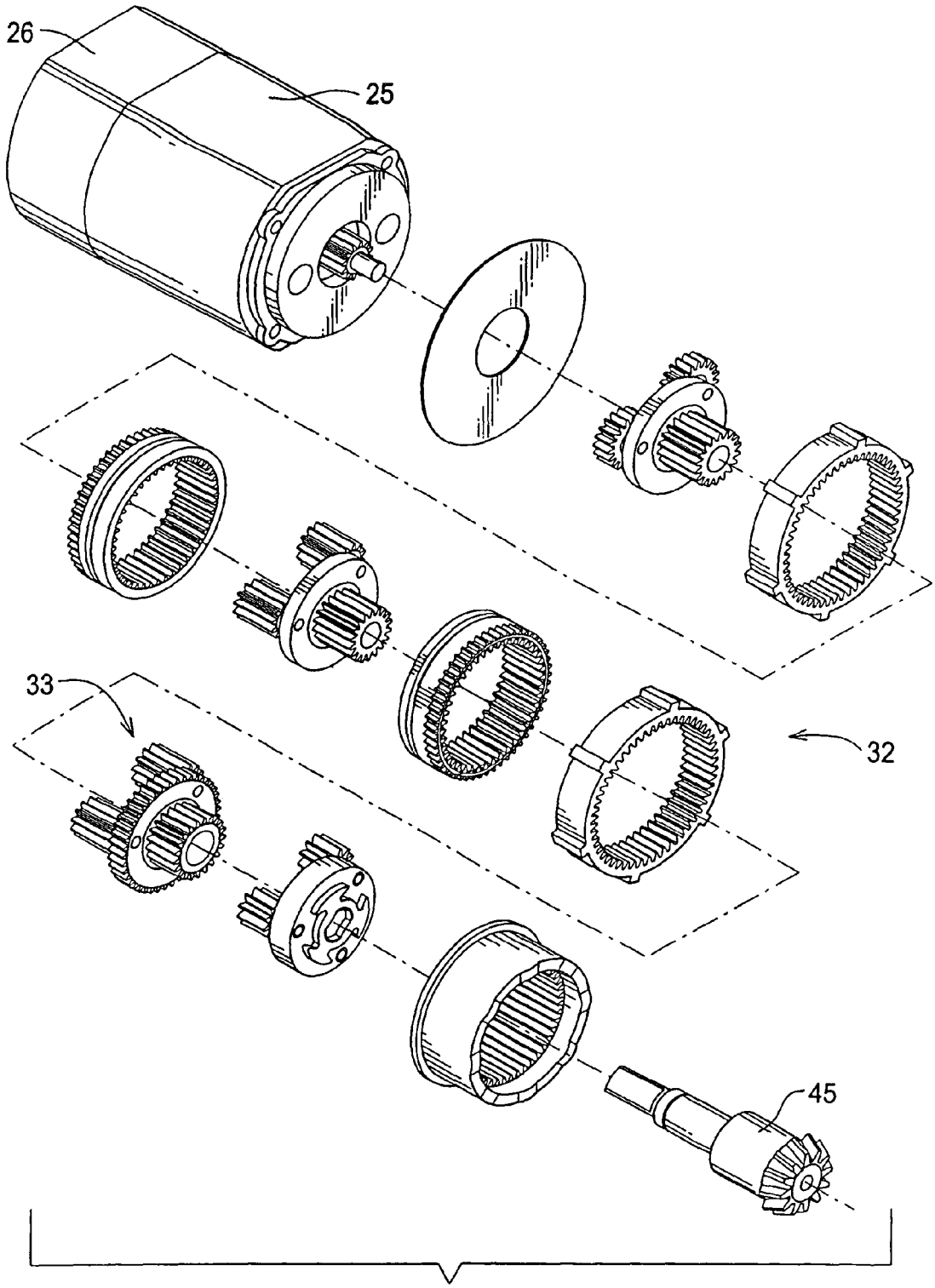
FIG. 4 a detailed exploded view of housed drive train elements not shown in FIG. 3.
Figure 5:
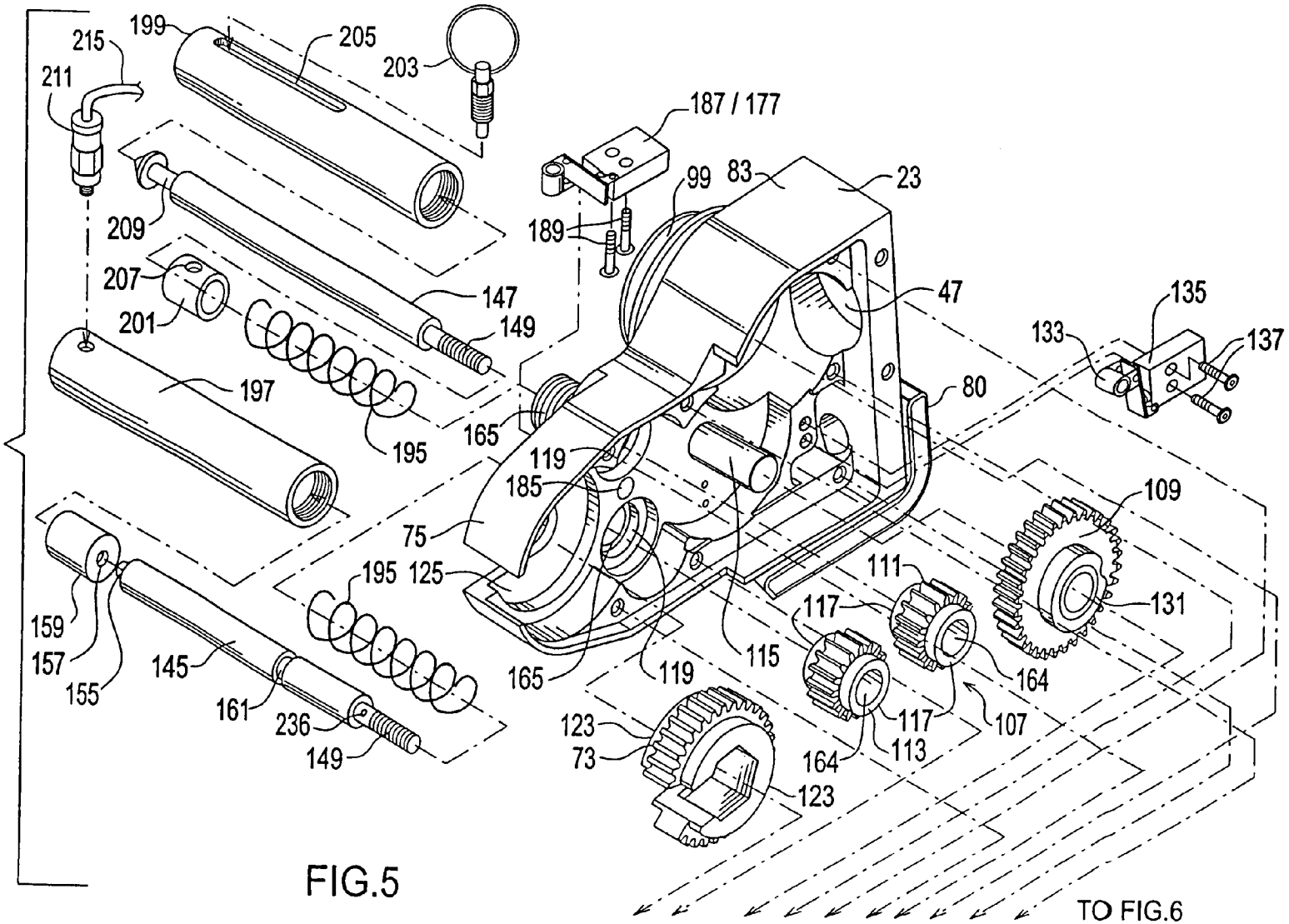
FIG. 5 is a partial exploded view of the driver head of the driver of this invention.
Figure 6:
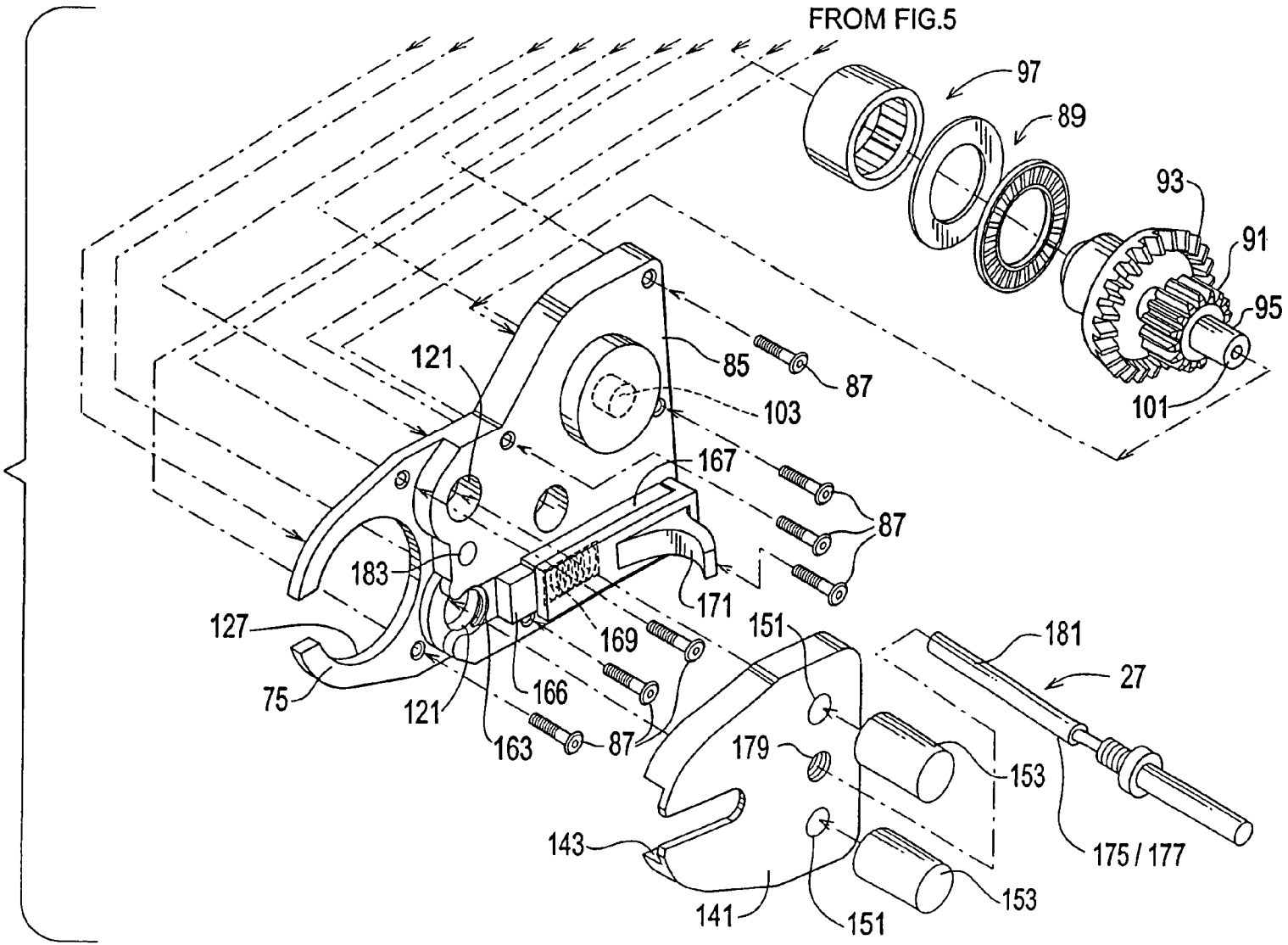
FIG. 6 is a second partial exploded view of the head of the driver of this invention.
Figure 7:
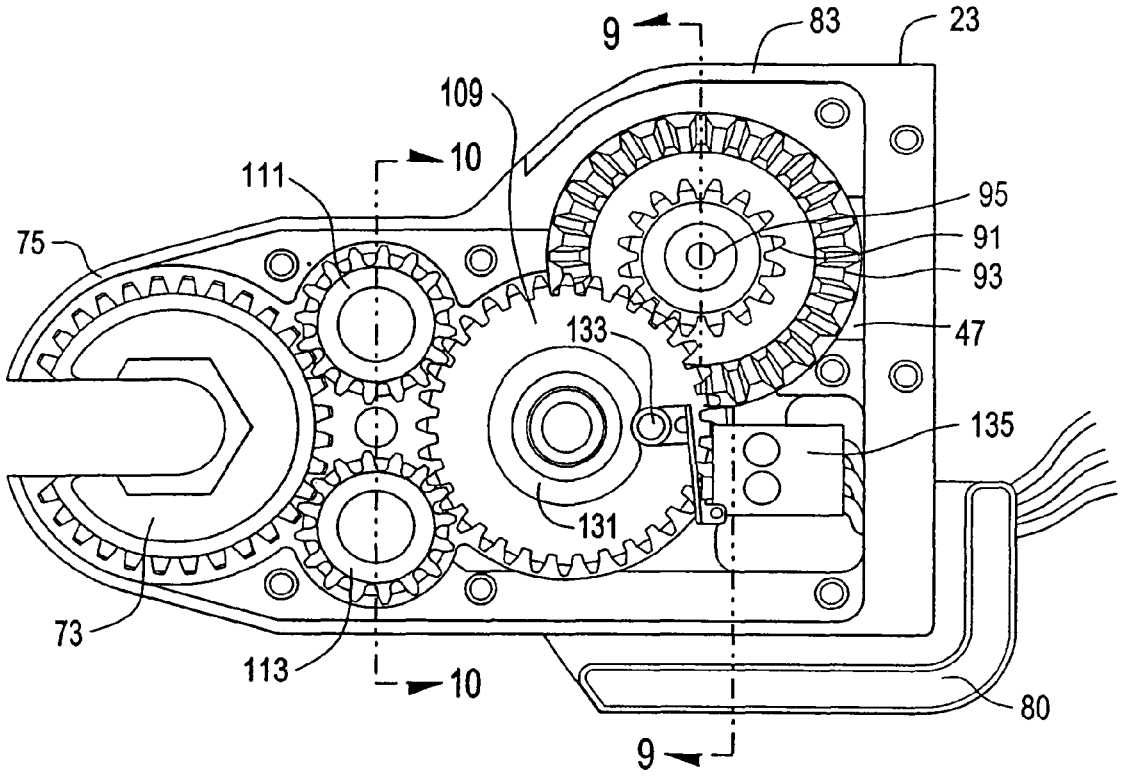
FIG. 7 an elevation view of the head of the driver of this invention with the top cover removed.
Figure 8:
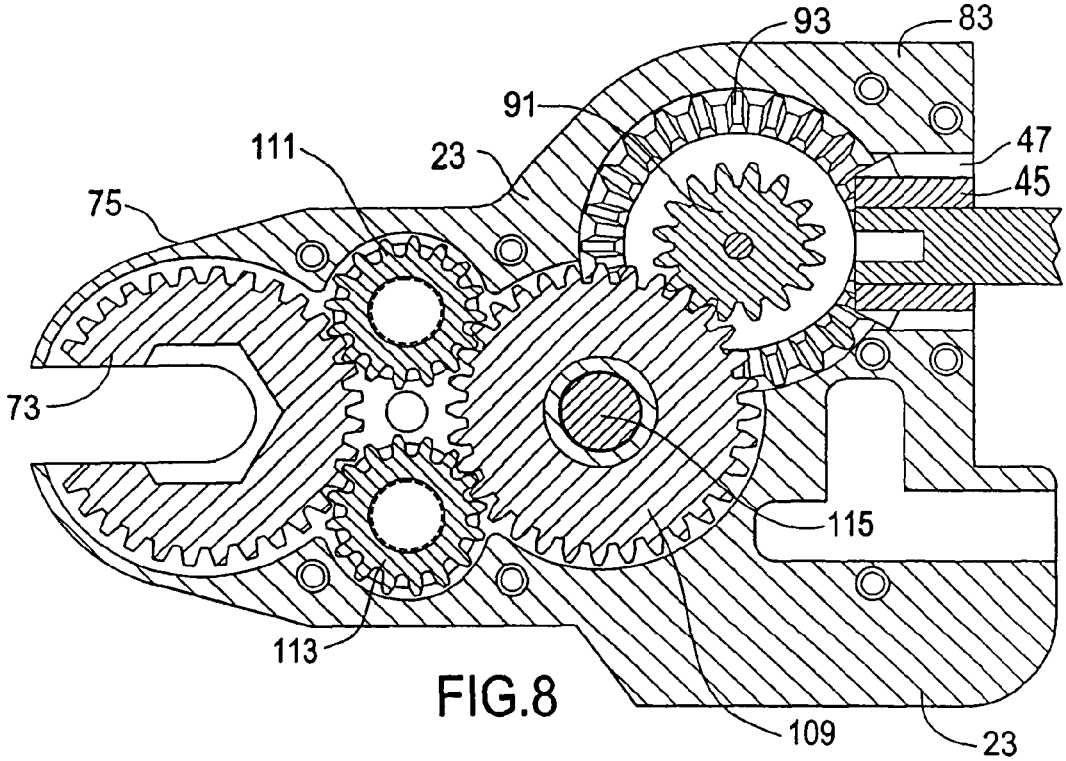
FIG. 8 is a sectional view taken along section lines 8-8 of FIG. 3.
Figure 9:
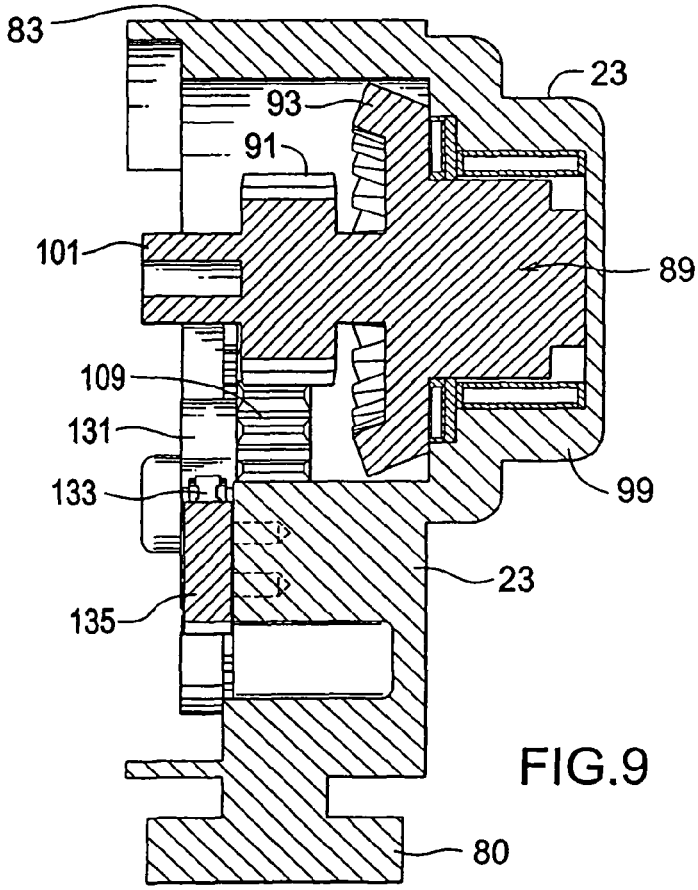
FIG. 9 is a sectional view taken along section lines 9-9 of FIG. 7.
Figure 10:
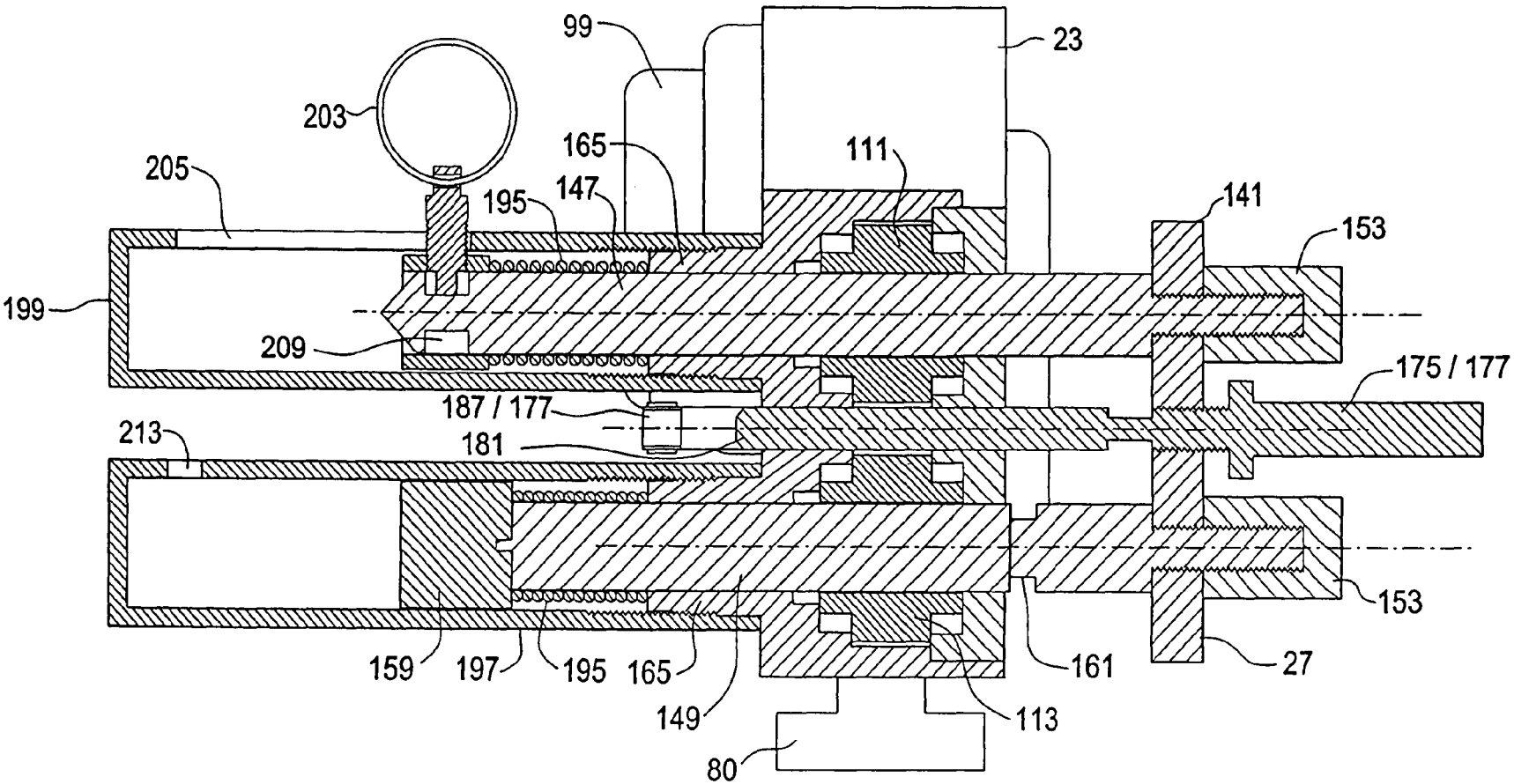
FIG. 10 is a sectional view taken along section lines 10-10 of FIG. 7 but with the top cover and reaction unit in place.

As shown in FIGS. 3 and 4, torque amplification modules 32 and 33 include discrete gear sets in separate housings to accommodate different torque output requirements in different tool configurations. The final output stage 33 includes primary drive output shaft and bevel gear 45 receivable through opening 47 at head 23 (see FIG. 5).

Operational switches, lights and ports are readily accessible, including main on/off switch 51, main operational running switch/trigger 53, forward and reverse jog rocker switch 55 (for advancing or retreating rotation by one to five degree increments), and lights switch 57 (operating white light 59 and red, night light 61). USB port 63 provides communication and data download capabilities (from onboard controller memory) as discussed hereinafter. Control lights 65, 67, 69 and 71 are provided to indicate tool on/off status (yellow—65) and socket status (67—green indicating socket 73 centering at jaw opening 75 and safety switch 77 tripped by placement of a line and fitting 79 (see FIG. 2)). Light 69 blinks (red) at each full rotation of socket 73, and thus a fitting engaged thereat, and light 71 indicates (blue) when the correct connector tightness (nut to fitting body gap, for example) has been achieved.

Housing 29 is preferably a split housing (as shown) held by common fastener techniques, with the housing, when assembled, capturing head 23 at mounting bracket 80. Modules 25, 26, 32 and 33 are affixed to one another and to head 23 utilizing standard screw type fasteners 82.

Turning now to FIGS. 5 through 10, head 23 and reaction unit 27 will be described in greater detail. Head 23 includes main body 83 and top cover 85 held together using screws 87. Gapped jaw 75 is utilized in this embodiment of the driver to accommodate use of a split socket tool 73 (a hex socket, for example) used to manipulate line fittings (79, as shown in FIG. 2). Drive translate assembly 89 includes stacked gears 91 and 93 on shaft 95 and bearing set 97 pressed into main body mounting 99, bevel gear 93 engaged by primary drive output gear 45 of final output stage 33 of torque amplification modules 32 and 33. The opposite end 101 of shaft 95 is rotatably fitted into mount 103 in cover 85.

Drive transfer gear assembly 107, including main drive gear 109 and idler gears 111 and 113, complete the drive train. Main drive gear 109 engages gear 91 of translate assembly 89 and is mounted on shaft 115 of main body 83. Idler gears 111/113 are used in split socket applications, providing constant drive application to socket 73 at their outer gear tooth surfaces, and are mounted on bearing shoulders 117 in housing detents 119 and cover openings 121. Socket 73 is mounted on bearing shoulder 123 in housing detent 125 and cover opening 127. Main drive gear 109 and socket 73 preferably are the same size and have the same gear tooth count at their outer gear tooth surfaces, so that rotation thereof is one to one. Cam surface 131 is provided at gear 109 and follower 133, the roller of roller switch 135, is mounted at main body 83 adjacent thereto using screws 137. This arrangement provides indication of socket 73 rotation at light 69 as well as socket location (in degrees) and rotation counting in onboard controller software or firmware.

Reaction unit 27 includes fitting engagement 141 (gapped for receipt of line fittings as shown in this embodiment) for engaging a utility related to the body of the connector being manipulated (for example, a line fitting body, the second part of a line fitting assembly not including the nut). Engagement 141 in this embodiment, for example, includes a sized slot 143 having surfaces configured to receive and securely hold a hexagonal fitting body. Rail guides 145 and 147 (a single guide could be utilized in some embodiments of the driver of this invention) are received at reduced diameter threaded ends 149 through openings 151 of engagement 141 and are held thereat by cap nuts 153.

Guide 145 includes second reduced diameter end 155 engageable (pressed into) opening 157 of piston 159. Guide 145 also includes intermediate annular slot 161 for capture and retention of reaction unit 27 by clip 163 at cover 85 (during fitting loading, reaction unit 27 must be held in an opened, disengaged position, since, as will be appreciated, the entire unit 27 is spring biased). Guides 145 and 147 are receivable through openings 121 in cover 85, through openings 164 of idler gears 111 and 113, and the openings into body 83 through threaded shoulders 165.

Clip 163 is mounted at the end of spring biased latch body 166 held in latch mount 167 attached to cover 85. Spring 169 is held in mount 167 between body 166 and mount 167 and biases body 166 so that clip 163 is urged toward and across one opening 121 of cover 85 and into engagement with rail guide 145. Release grip 171 protrudes from body 166 allowing user access for movement of latch body 166. Sliding movement of reaction unit 27 on guides 145 and 147 (against unit bias as discussed hereinafter) away from head 23 eventually results in movement of clip 163 into engagement at annular slot 161 thus allowing cocked retention of reaction unit 27 at this position. Once a fitting is correctly positioned at the driver, retraction of latch body 166 using release grip 171 by a user frees clip 163 from slot 161 allowing movement of unit 27 toward head 23 and into correspondence with a connector utility at engagement 141.

Figure 11:
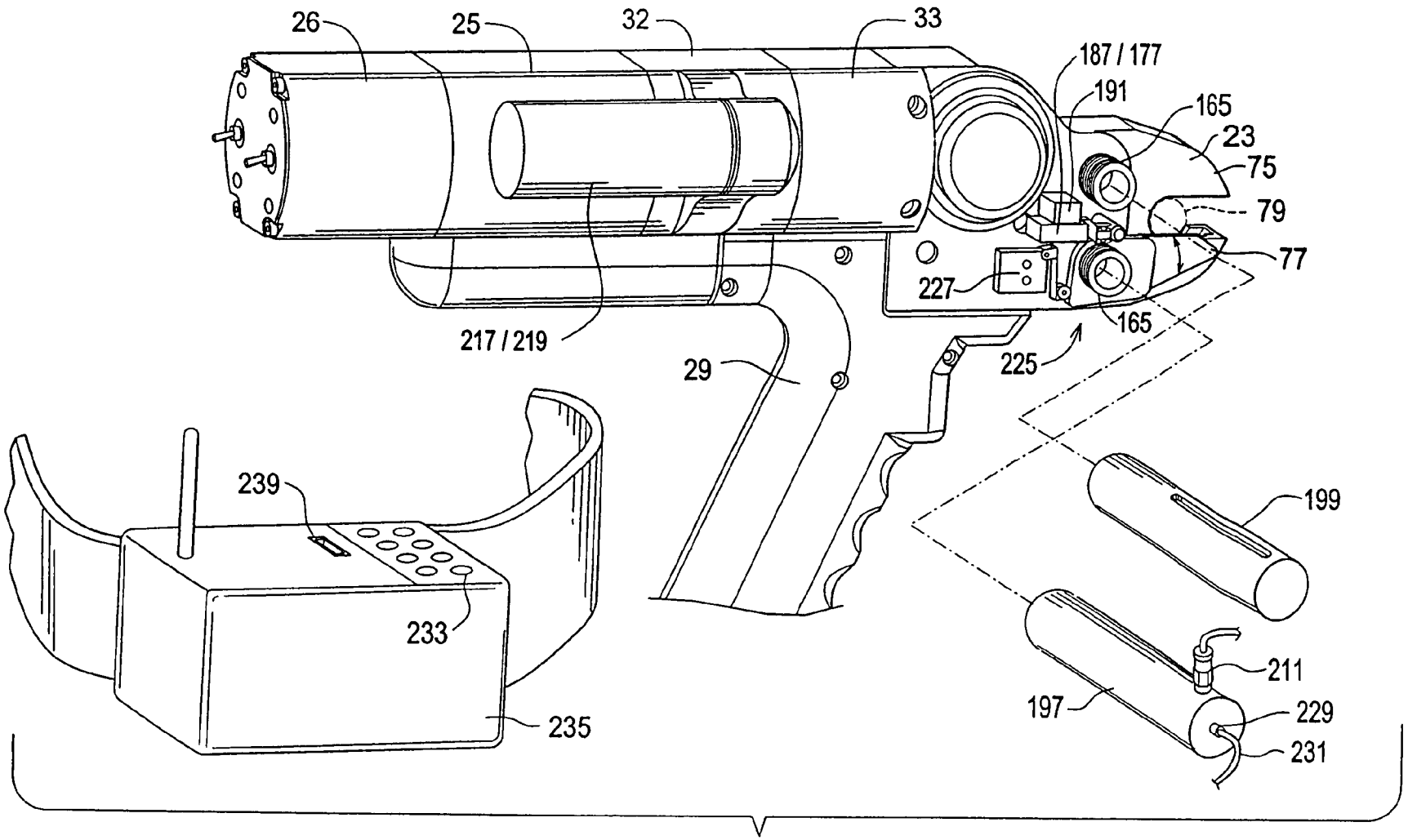
FIG. 11 is a partially exploded perspective view showing additional features which may accompany the driver of this invention.

Probe component 175 of switching assembly 177 is threadably received through opening 179 of engagement 141, probe reach being adjustable by extent of threaded engagement. Probe end 181 is receivable through openings 183 and 185 in cover 85 and body 83, respectively. Switch component 187 of assembly 177 (a roller switch, for example) is attached by screws 189 to a mounting block 191 (as shown in FIG. 11) on body 83 to position the roller of roller switch 187 over opening 185 and thus in the path of probe end 181. Switch component 187 is operatively linked (through controls as shown hereinafter) with the main motor of the driver to decouple motive force when tripped by probe end 181.

Engagement 141 of reaction unit 27 is biased toward driver head 23 (and particularly toward socket 73) by springs 195 in closed ended retainers 197 and 199 threadably engaged at shoulders 165. Springs 195 are maintained between shoulders 165 and piston 159 at retainer 197 and slide 201 at retainer 199 thus biasing the piston and the slide (and so guides 145 and 147 and the rest of reaction unit 27) toward the closed ends of the retainers 197 and 199. Slide 201 is retained at the end of guide 147 by manually releasable spring clip 203 received through slide slot 205, threaded opening 207 in slide 201 and annular slot 209 at guide 147. When spring clip 203 is retracted from slot 209 thus releasing guide 147, reaction unit 27 may be fully withdrawn from head 23.

As may be appreciated, as a fitting nut is tightened on a fitting body using the driver of this invention, engagement 141 of reaction unit 27 in contact with the fitting body is biased toward socket 73 at the same rate as the nut moves toward the fitting body. At the same time, probe end 181 is proceeding at this rate toward switch component 187. By virtue of probe length and/or geometry selection (either factory selected for particular operations, threadably adjustable, or by selection and installation of one of a variety of probe components having different selected lengths for different fitting specifications), switch contact occurs when correct connector or fitting (nut to body gap) tightness is achieved thereby causing cessation of socket rotation. Such operations are highly predictable and thus repeatable. Since most motor and drive trains have overrun (i.e., a few degrees of continued rotation due to system momentum), the driver is programmed with an automatic reverse rotation at the end of the tightening cycle corresponding to estimated system overrun to relieve system tension without changing nut torque. Use of the jogging function can provide further tightening or loosening as desired. After disengagement from a tightened fitting, split socket 73 is run to the gap centered position relative to jaw opening 75 (for example, in a fully automated mode, by a subsequent press of trigger switch 53 after release thereby running socket 73 to the centered position—indicated by light 67—and resetting the driver for a new connector driving cycle).

Reaction unit 27 may be manually reset for a new cycle ("cocked" as described above) or may be reset by pneumatic means as shown herein. Pneumatic fitting 211 is threaded at opening 213 of retainer 197 and connected by line 215 with valve 217 and pressurized gas cylinder 219. After a fitting is tightened, triggering valve 217 causes a burst of gas to enter retainer 197 through opening 213 forcing piston 159 against spring bias to move guide 149 (and thus unit 27, releasing and resetting switch component 187) until slot 161 captures spring biased retaining clip 163.

Figure 12:
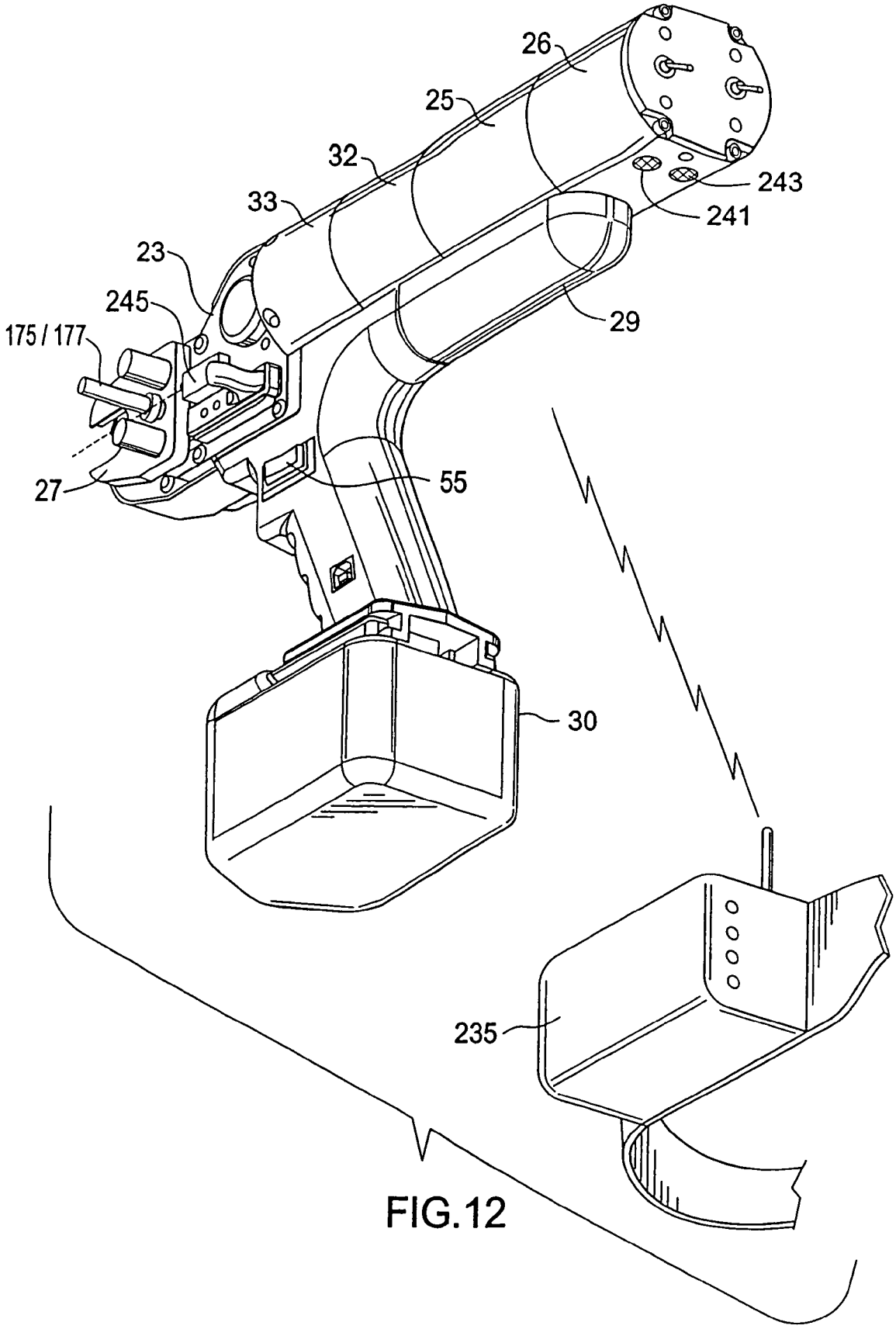
FIG. 12 is a perspective view illustrating still other additional features which may accompany the driver of this invention.

Turning to FIGS. 11 and 12, several additional driver features may be provided to enhance safety and utility. Safety switch assembly 225 includes switch 77 pivotably biased to a position closing gapped jaw 75. When forced open by a line or other fitting 79, switch 77 geometry causes engagement at roller switch 227 attached to head 23 thereby electrically enabling driver operation. A second pneumatic fitting 229 is positioned for access to the interior of retainer 197. Line 231 connected with fitting 229 is received at port 233 of a test fixture 235 to thereby receive continuously aspirated samples from the fitting\connector union area through retainer 197 and bore hole 236 through guide 145 (see FIG. 5). Leak detection at a fitting may thus be accommodated.

Test fixture 235 may be belt mounted, as shown, and may include a USB input 239 (for communication through the USB port at the driver or with a base computer). BLUE TOOTH and/or radio communication may be provided for data download from the driver or upload from a base station. Cellular technology may also be accommodated for the user, with a speaker 241 and microphone 243 positioned at housing 29 or any of the driver modules. Real time video may be provided at video unit 245 (and downloaded or stored with appropriate in-situ memory), allowing remote review of operations and/or a record of completed tasks.

Figure 13:
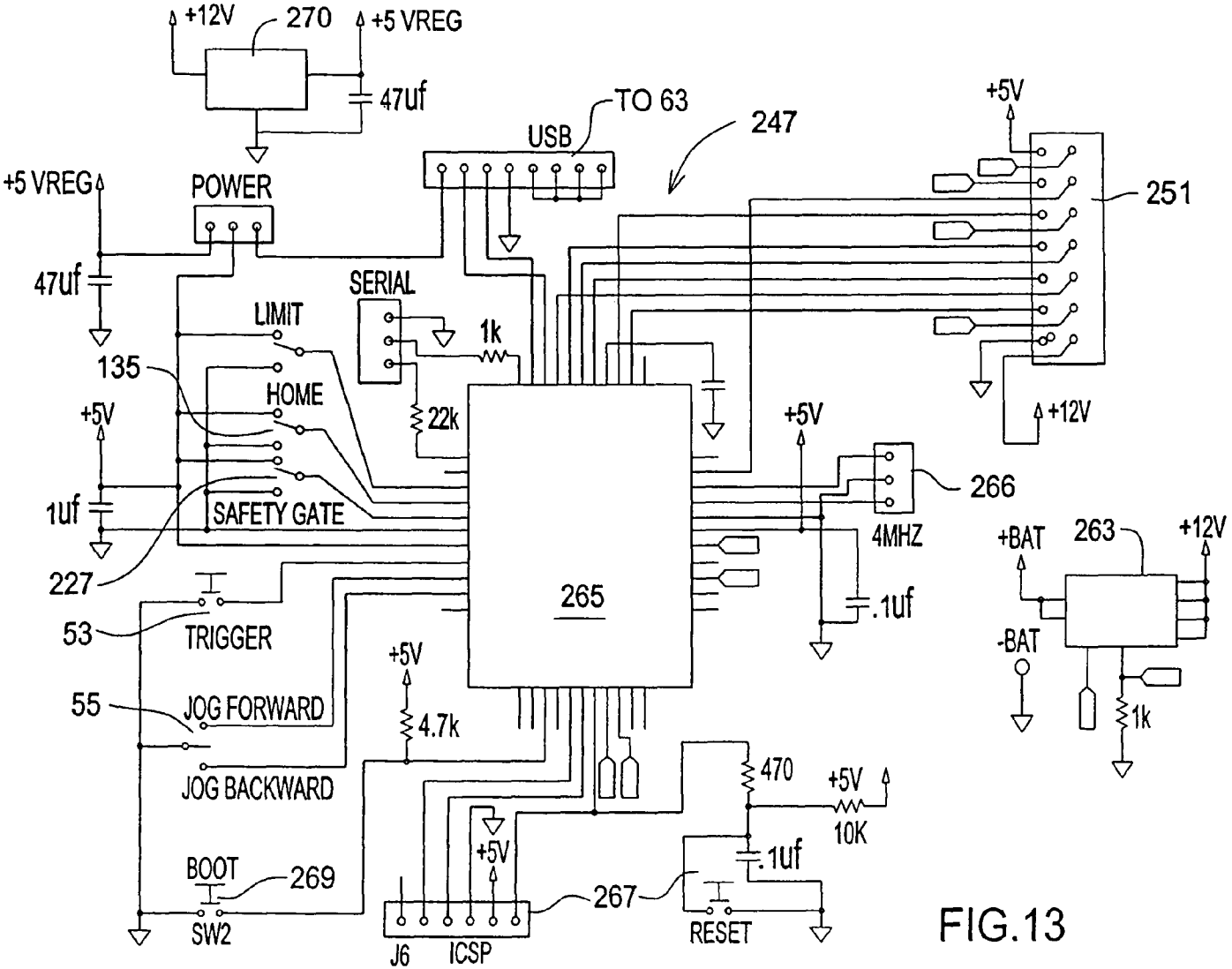
FIGS. 13 through 15 are schematic diagrams showing the electronics of the driver of this invention.
Figure 14:
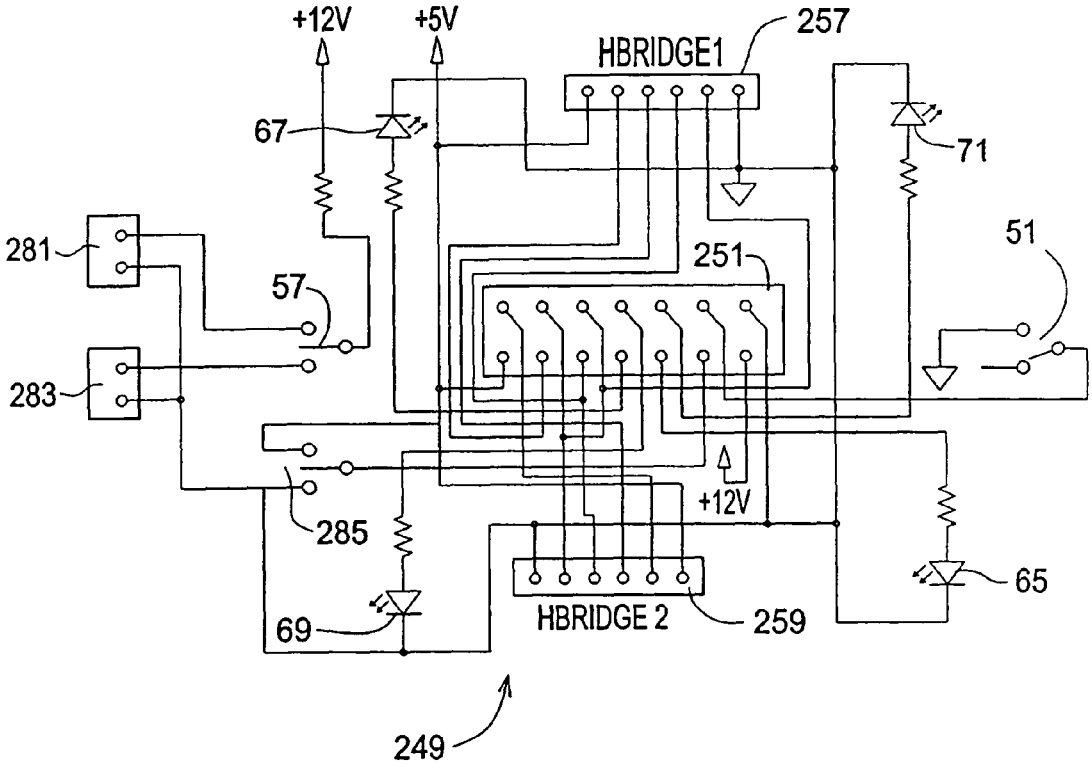
Figure 15:
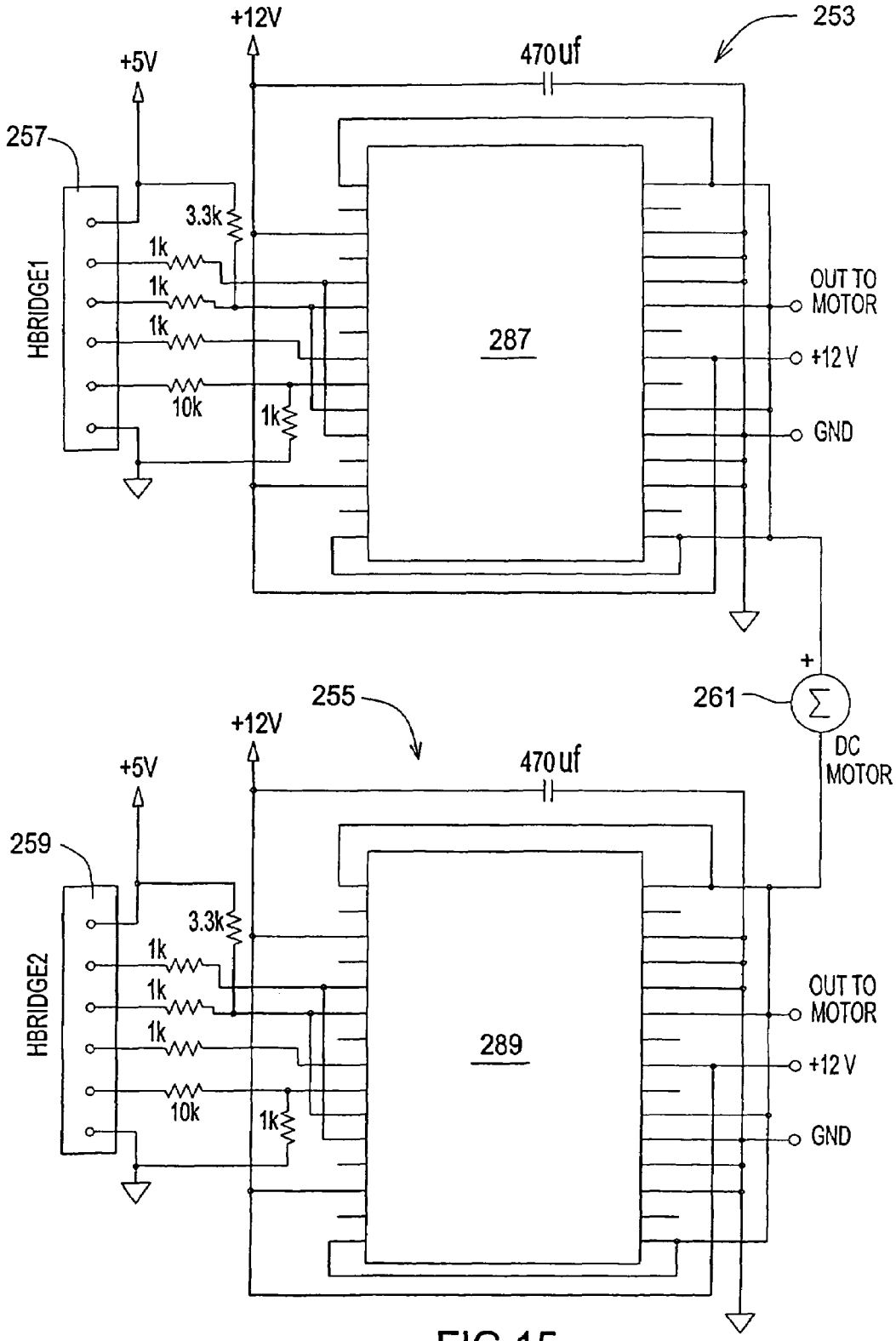
Figure 16:
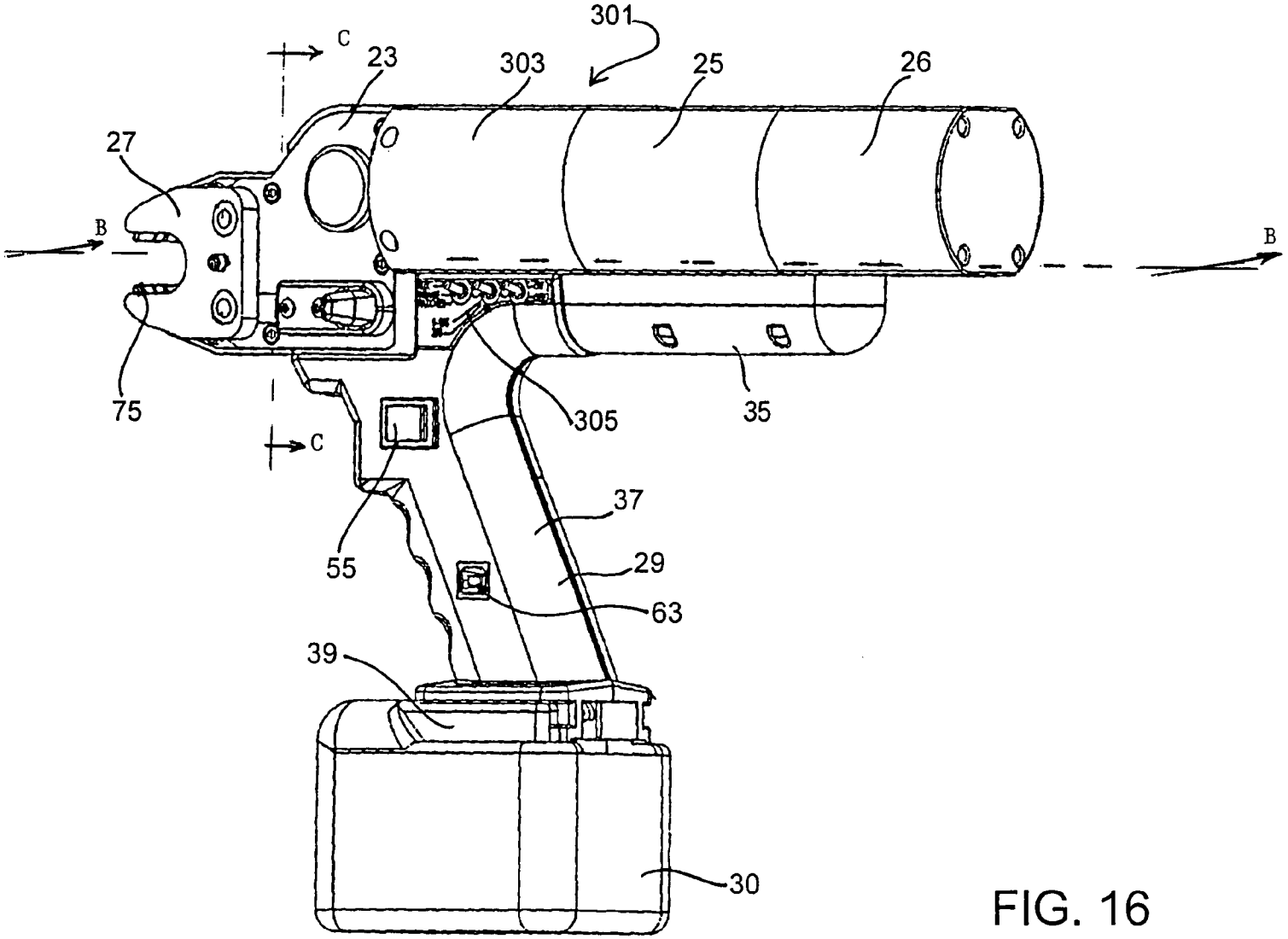
FIG. 16 is a perspective view of showing a second, and now preferred, embodiment of the driver of this invention.

FIGS. 13 through 15 illustrate the electronic implementation of driver 21 of this invention, the boards described hereinafter housed in module 26. Main control board 247 (FIG. 13) is connected with switching board 249 (FIG. 14) at port connectors 251. Board 249 is connected with the two one-half h-bridge circuits 253 and 255 at connectors 257 and 259 (FIG. 15), the h-bridge circuits driving motor 261 (housed at module 25) in a conventional arrangement. Main board 247 includes a smart highside current power switch arrangement 263 (for example, a PROFET BTS660P by INFINEON TECHNOLOGIES) and a Flash USB ready microcontroller 265 (for example, a PIC18F2455/2550/4455/4550 series 28/40/44 pin microprocessor by MICROCHIP TECHNOLOGY, INC.) connected with clock oscillator 266. USB signals are accommodated at the connector to USB port 63.

Programming/reset circuits 267 are provided for programming and troubleshooting with programming switch 269 (modes may include everything from fully manual to fully automated), and voltage regulation is provided by regulator circuit 270. Momentary rocker switch 55 with center off provides for input to controller 265 of jog functions, and trigger switch 53 inputs running commands. Safety gate switch 227 inputs run ready signals, and rotation counter switch 135 inputs socket rotation count/location data.

Connectors 281 and 283 at switching board 249 are connected with lights 61 and 59, respectively, for operations responsive to switch 57 actuation. Switch 285 is a mode selection switch (manual or auto). On/off switch 51 signals are input through board, and motor control signals are output through, board 249. H-bridge circuits 253 and 255 include integrated motor drivers 287 and 289, respectively (for example, VNH2SP30-E drivers from ST).

Second embodiment 301 of the driver of this invention including various now-preferred fitting integrity gauging techniques and apparatus is shown in FIGS. 16 through 23. Unchanged elements of the driver will be numbered in the drawings as heretofore identified (or will remain unidentified if not pertinent to the changes in embodiment 301). Driver embodiment 301 includes a combined torque amplification module 303 adapted to replace the separate modules heretofore shown but functioning in a similar manner (and having output at a bevel gear of the type shown heretofore at 45). User manipulable control array 305 is located at barrel 35 and includes switching associated with controller 265. The switching includes main on/off switch 57, three way operational mode selection switch 307 and two way nut/socket rotation limitation selection switch 309 (see FIG. 19).

Figure 17:
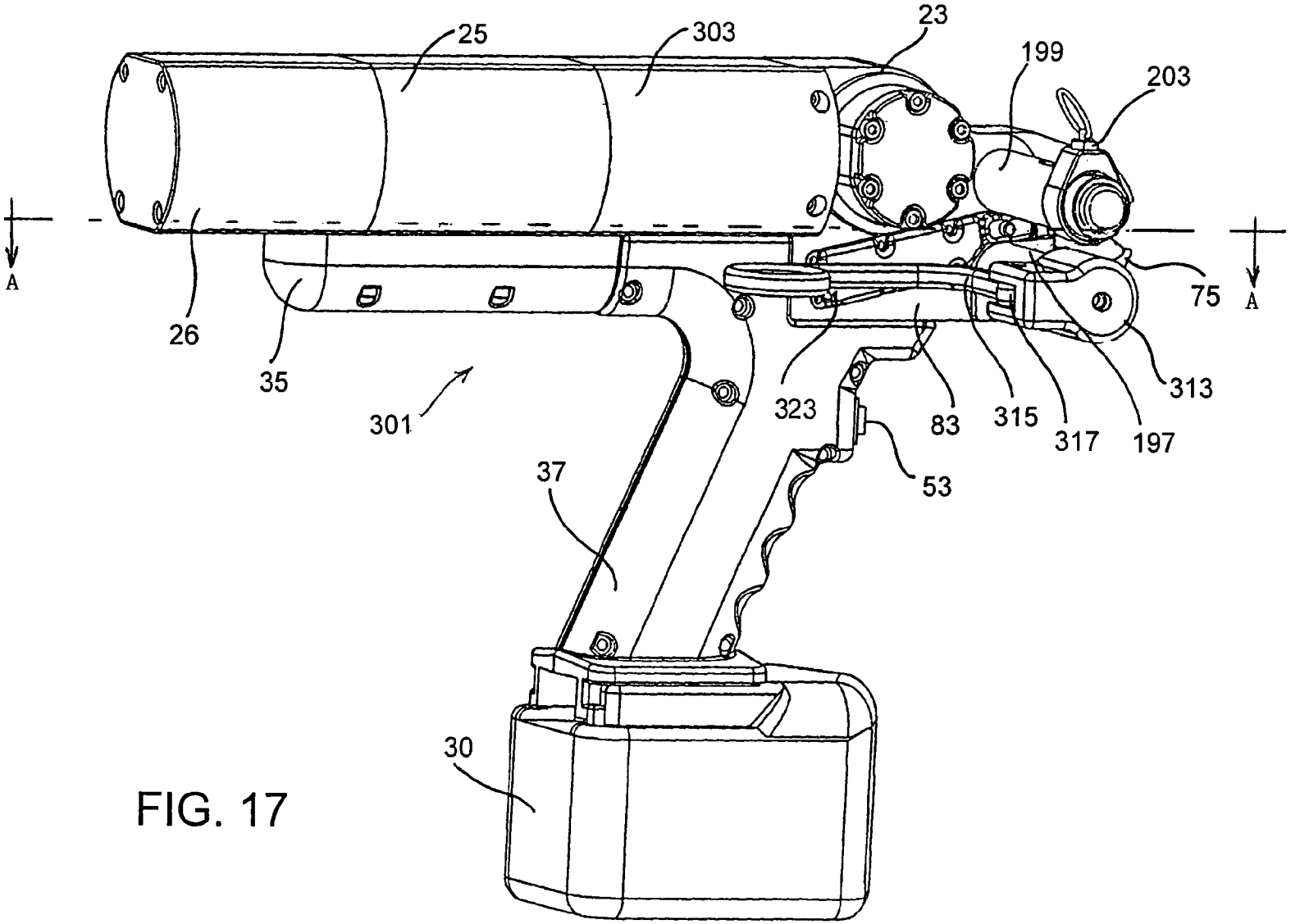
FIG. 17 is another perspective view of the driver shown in FIG. 16.
Figure 18:
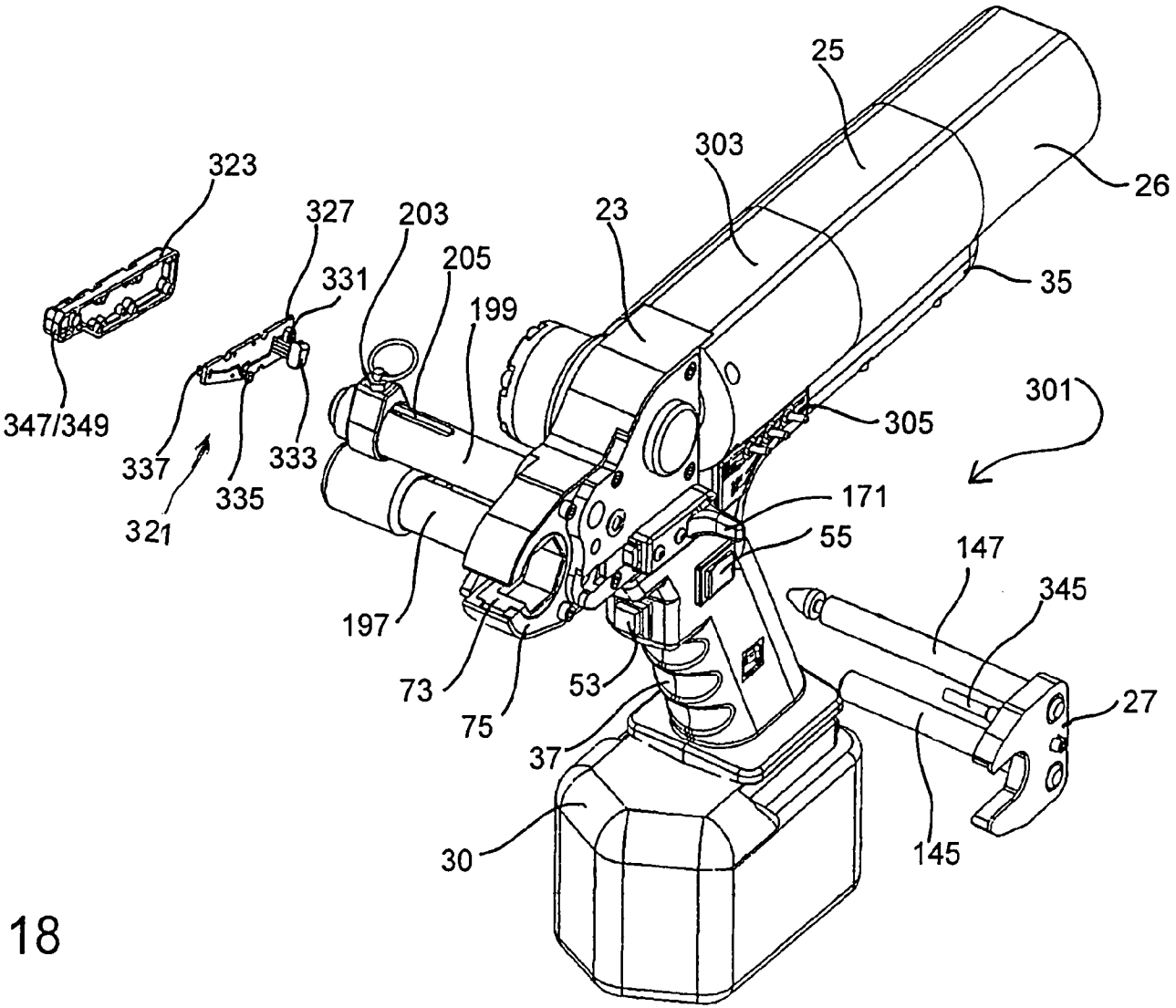
FIG. 18 is an exploded view of the driver shown in FIG. 16.
Figure 19:
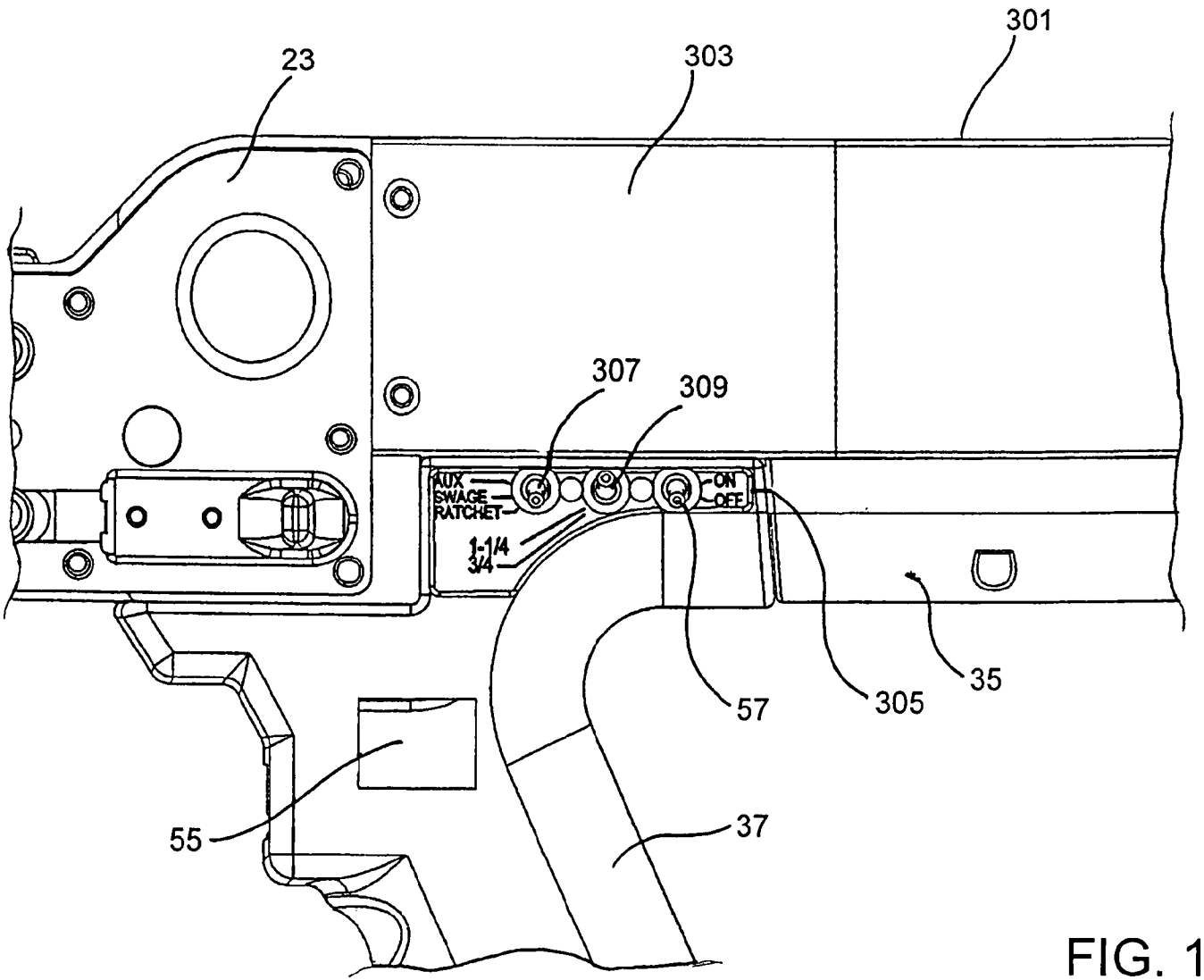
FIG. 19 is a partial side view illustrating user operational controls and indicators of the driver shown in FIG. 16.
Figure 20:
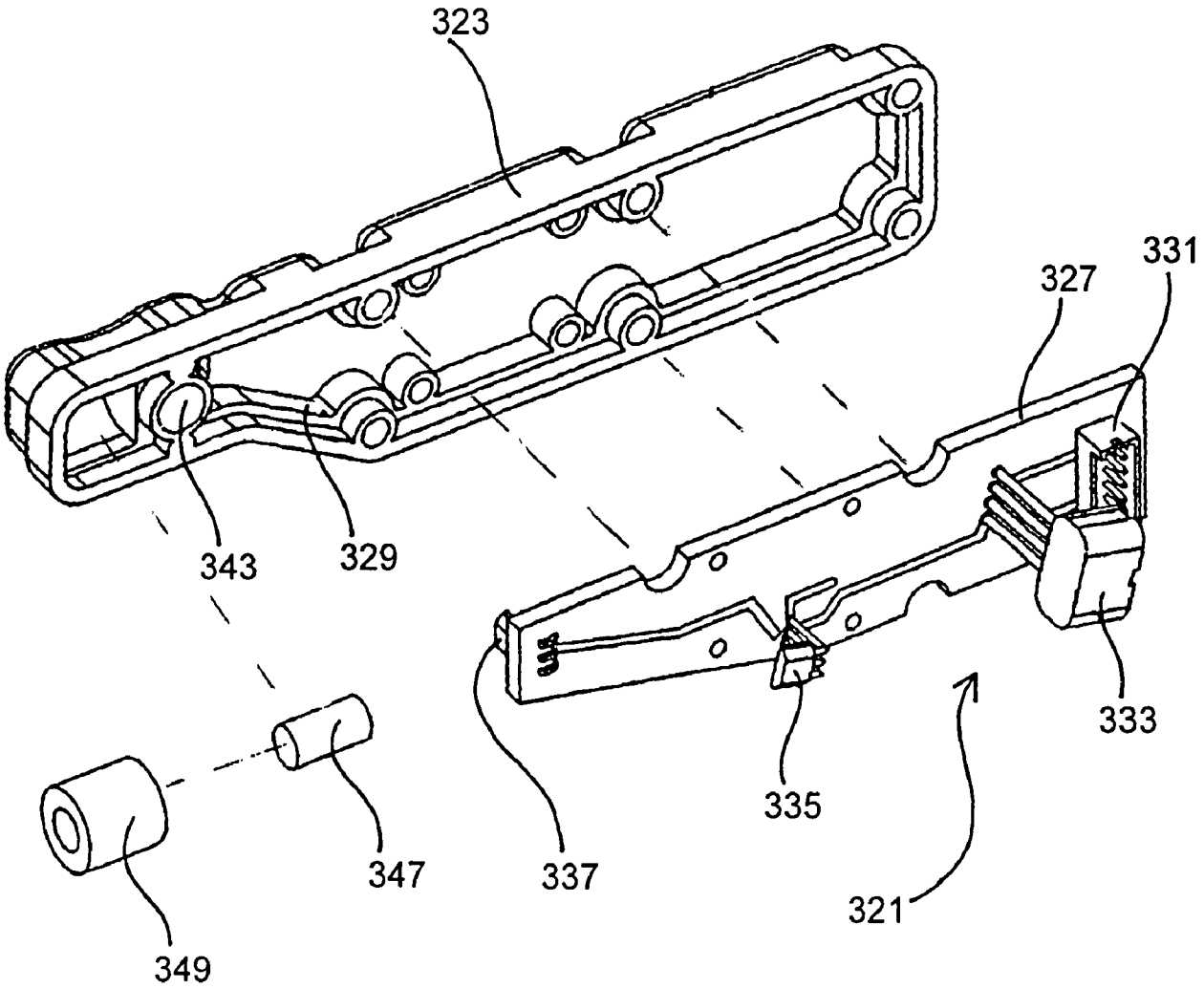
FIG. 20 is a perspective view of the operations sensor array of the driver shown in FIG. 16.
Figure 21:
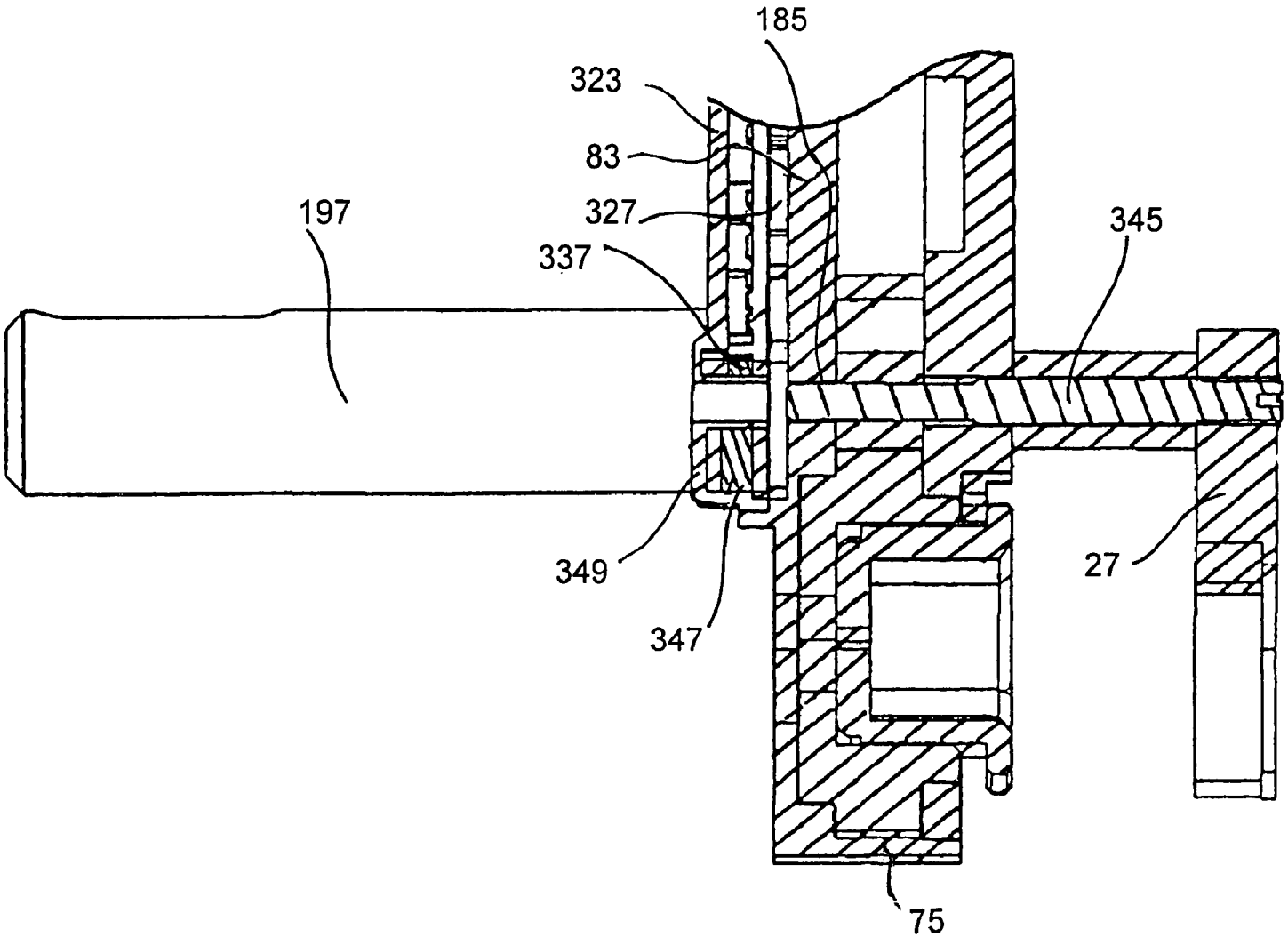
FIGS. 21 and 22 are partial sectional views taken along section lines A-A of FIG. 17.
Figure 22:
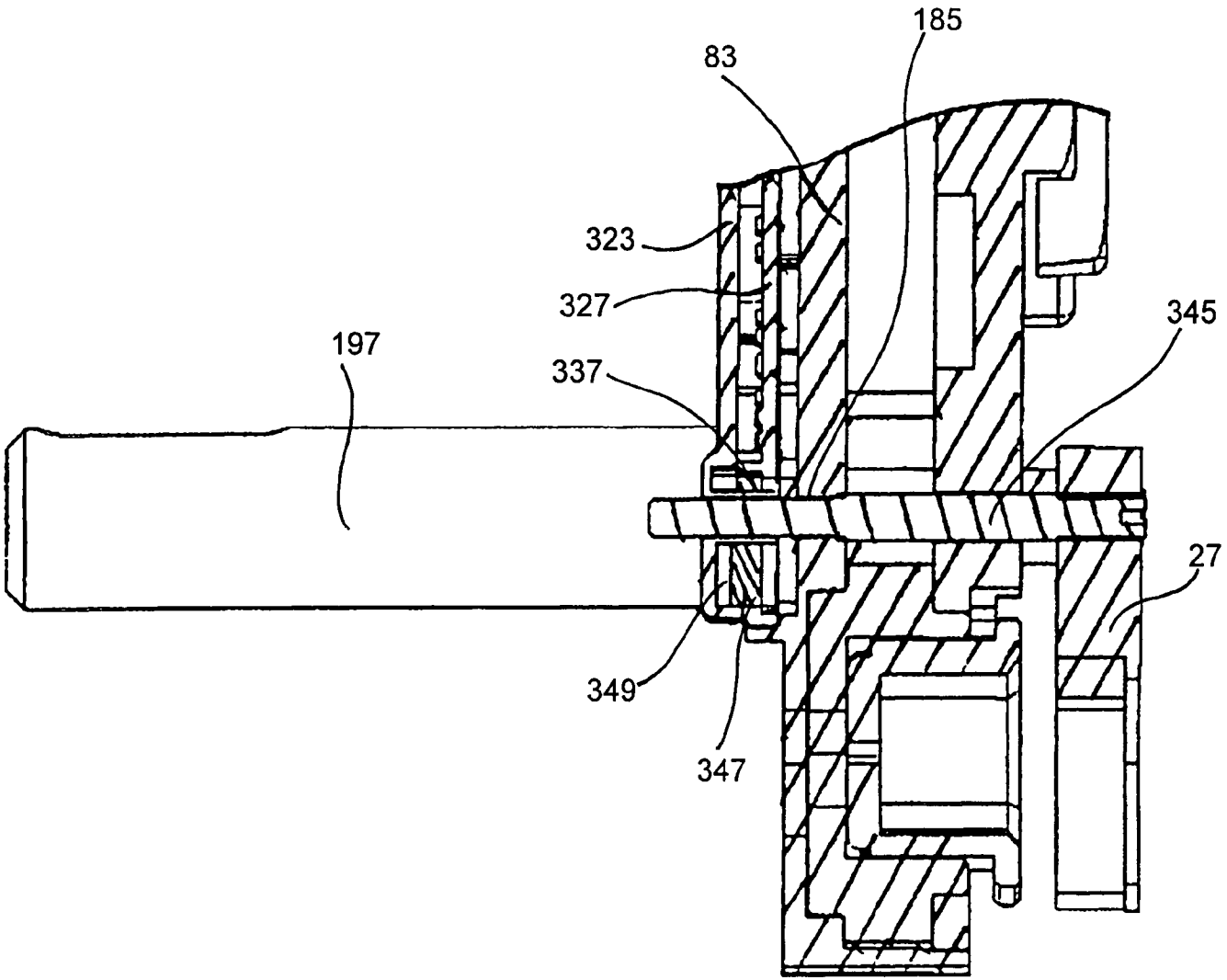
Figure 23A:
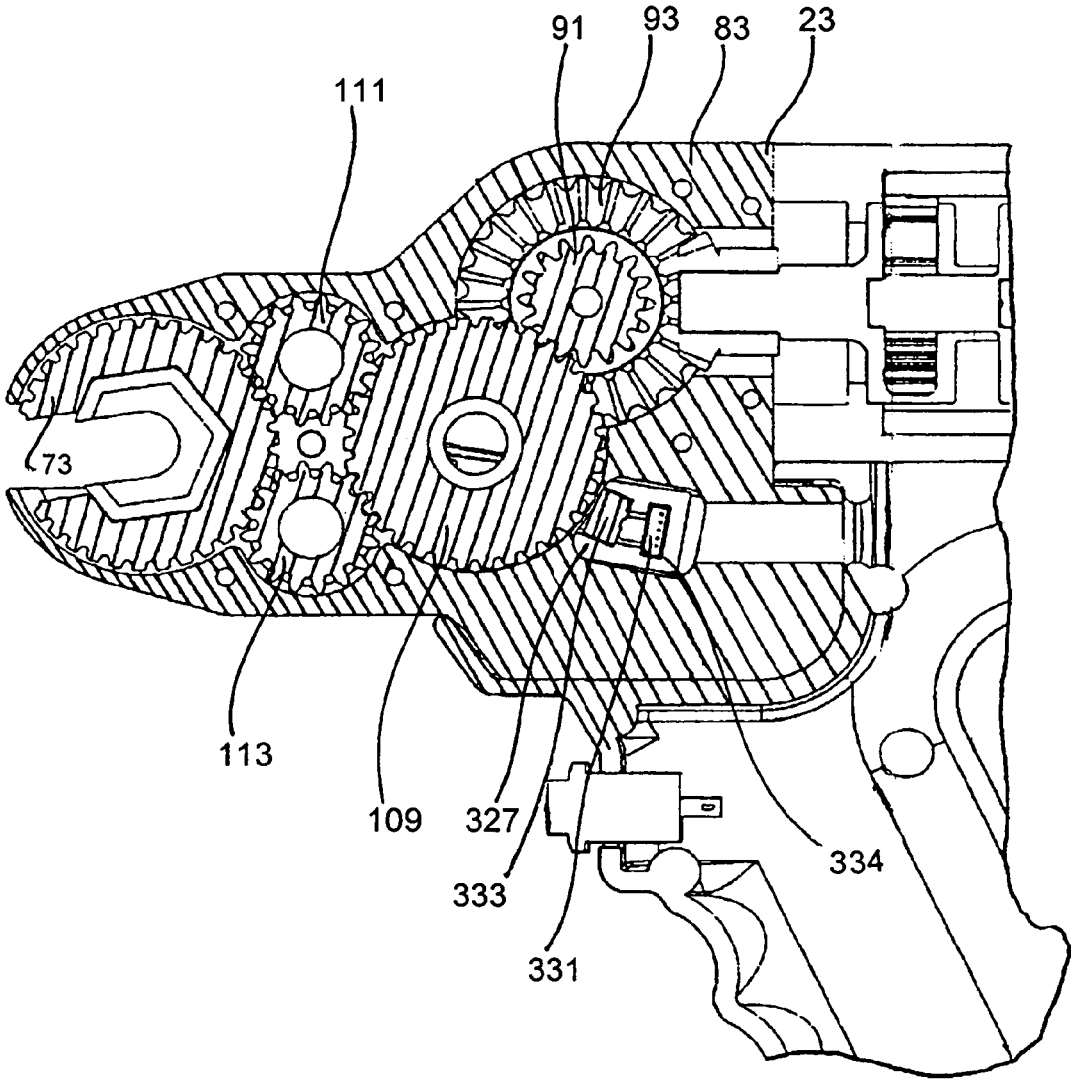
FIG. 23A is a partial sectional view taken along section lines B-B of FIG. 16.
Figure 23B:
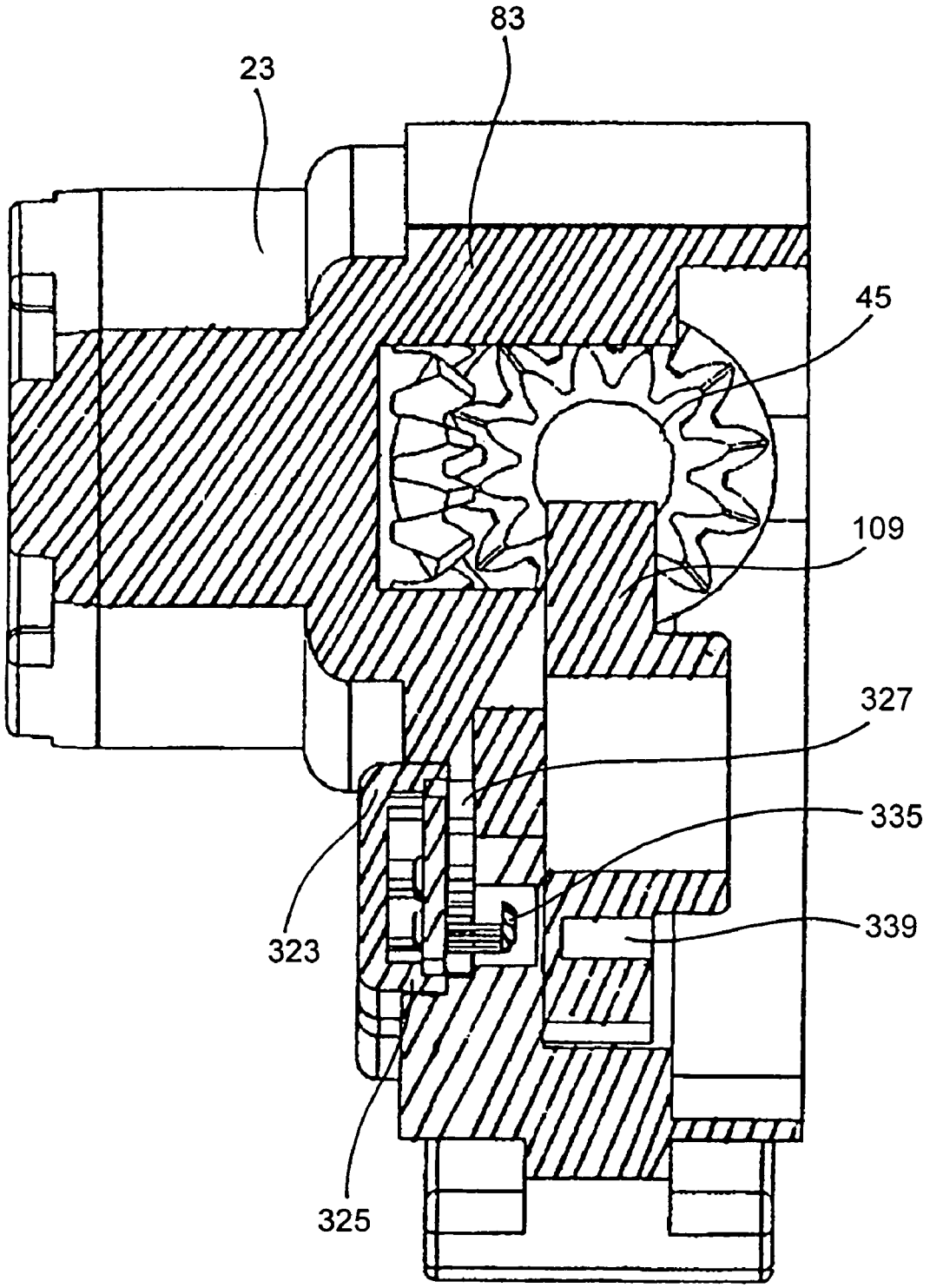
FIG. 23B is a sectional view taken along section lines C-C of FIG. 16.

As shown in FIGS. 17, 21 and 22, manual reset arm assembly 311 is provided for cocking reaction unit 27 for a new operational cycle. Assembly 311 includes retainer 313, reset arm 315 operable across pivot 317 to manipulate integrated ram 319 abutting rail guide 145. Non-contact sensor array 321 (preferably an array of hall effects sensors) is contained by main array cover 323 secured to main body 83 of head 23 and covering opening 325 (see FIG. 23B) therethrough. Sensor array 321 is mounted on board 327 secured in turn at recess 329 of cover 323 using conventional means (see FIGS. 18 and 20). The array includes output port connector 331 for communicating the output from Hall effects sensors 333, 335 and 337 to the main driver circuitry. Cover 323 is preferably clear or opaque to allow visual inspection of integrated lights (see FIG. 29) for user operational monitoring.

Sensor 333 includes an integrated magnet molded on the back of the sensor that creates a field around the sensor. Sensor 333 is positioned in pocket 334 in head 23 (the head is preferably made of aluminum) so that the sensor and field are concentrated on and in proximity to the teeth of drive gear 109 (see FIG. 23A). Disturbances in the magnetic field are caused by passage of the individual teeth and valleys between teeth during rotation of gear 109, and these disturbances are sensed and by sensor 333. The sensed disturbances are counted, thus essentially providing a count of gear 109 teeth passing the sensor during a given period, thereby to communicate monitored angular location data equivalent to observed rotation of gear 109 to controller 265. This data may be utilized as noted heretofore (replacing cam and switch 131/133/135). Since the number of teeth on the gear is known, with Hall effects sensor 333 operating in a conventional manner angular rotation of socket 73 (having the same number of teeth) can be calculated. While sensing of this data is shown at the drive gear, the same data could be gathered by placement of the sensor adjacent to any of the other gear tooth surfaces utilized in the driver, though in some cases conversion calculations would be required.

Sensor 335 is responsive to magnet 339 mounted on drive gear 109 (see FIG. 23B) in head 23 to communicate monitored precise location of the gap in socket 73 to index the gap with the equivalent gap in jaw 75 for application and removal of the tool from a fitting. This is accomplished by causing cessation of gear rotation when sensor 335 senses optimum field strength/location of magnet 339. This cessation location (with magnet 339 in closest proximity to sensor 335) is precisely indexed with the exact coincidence of the gaps in split socket tool 73 and jaw 75 of head 23. The monitored indexing data is communicated to controller 265.

Sensor 337 is located adjacent to passageway opening 185 through driver head body 83 and opening 343 of cover 323. As shown in FIGS. 18, 20, 21 and 22, cover 323 houses and carries magnet 347 in magnet holder at one end thereof. Sensor 337 is responsive to the movement of the distal end of probe 345 of reaction unit 27 through the field of magnet 347 as it moves from a fitting unsecured location (FIG. 21) and passes the sensor (FIG. 22) to indicate proper tightness of a fitting being secured by driver 301 (thus replacing switch 187/177 functionally with a more durable switching unit less subject to corruption from moisture and chemical contamination and the like). Monitored data related to relative position of the driver head/socket/nut and reaction unit/probe/connector body is communicated to controller 265.

Figure 24:
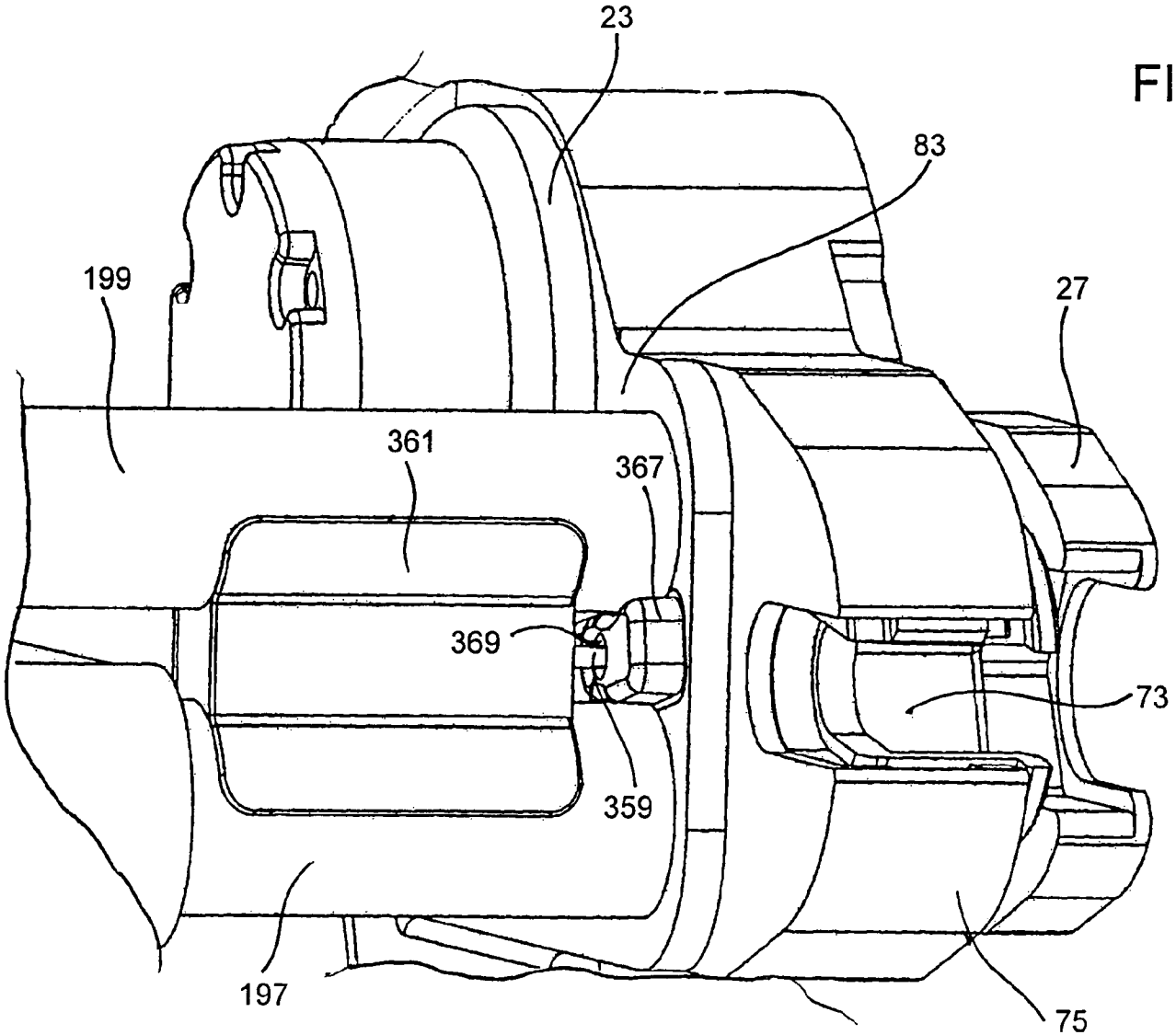
FIG. 24 is a partial perspective view of another alternative operations gauging implementation usable with the driver of this invention.
Figure 25:
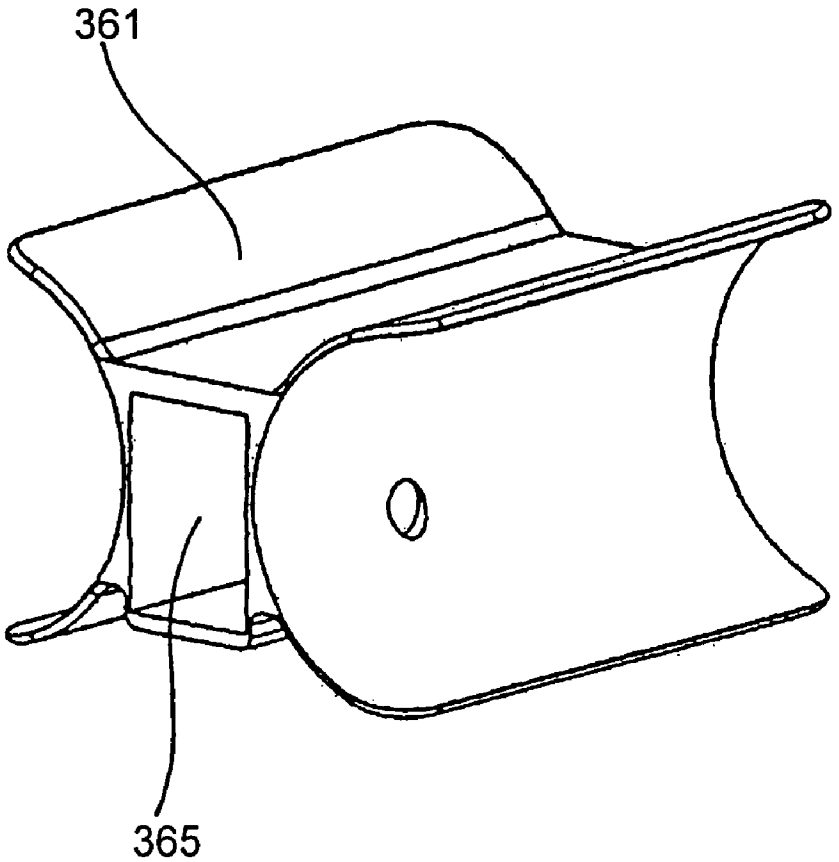
FIG. 25 is a is an exploded view of the implementations of FIG. 24.
Figure 25:
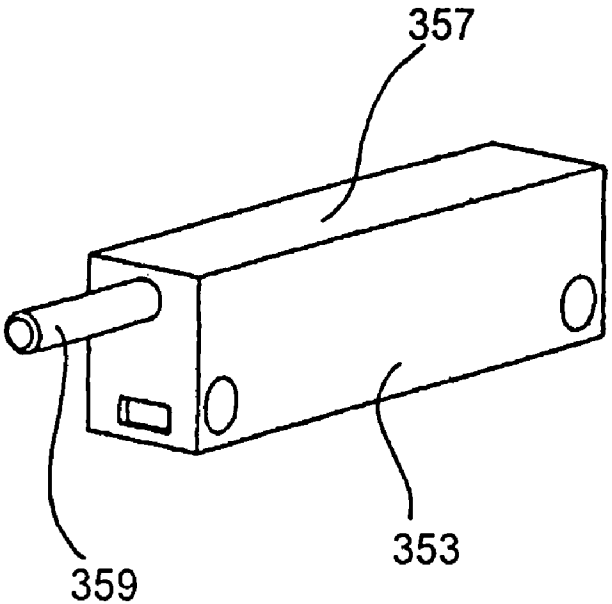
Figure 26:
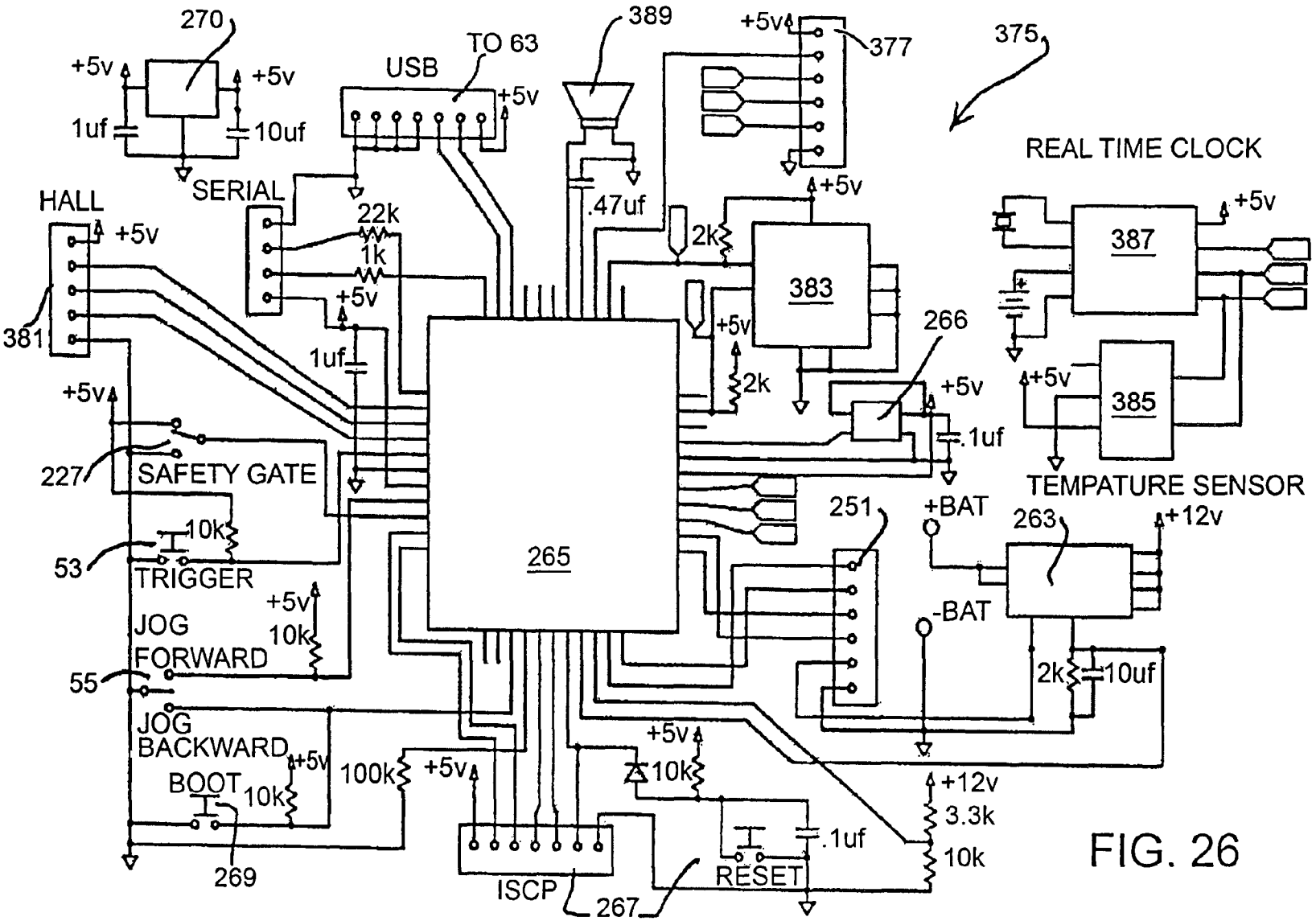
Figure 30:
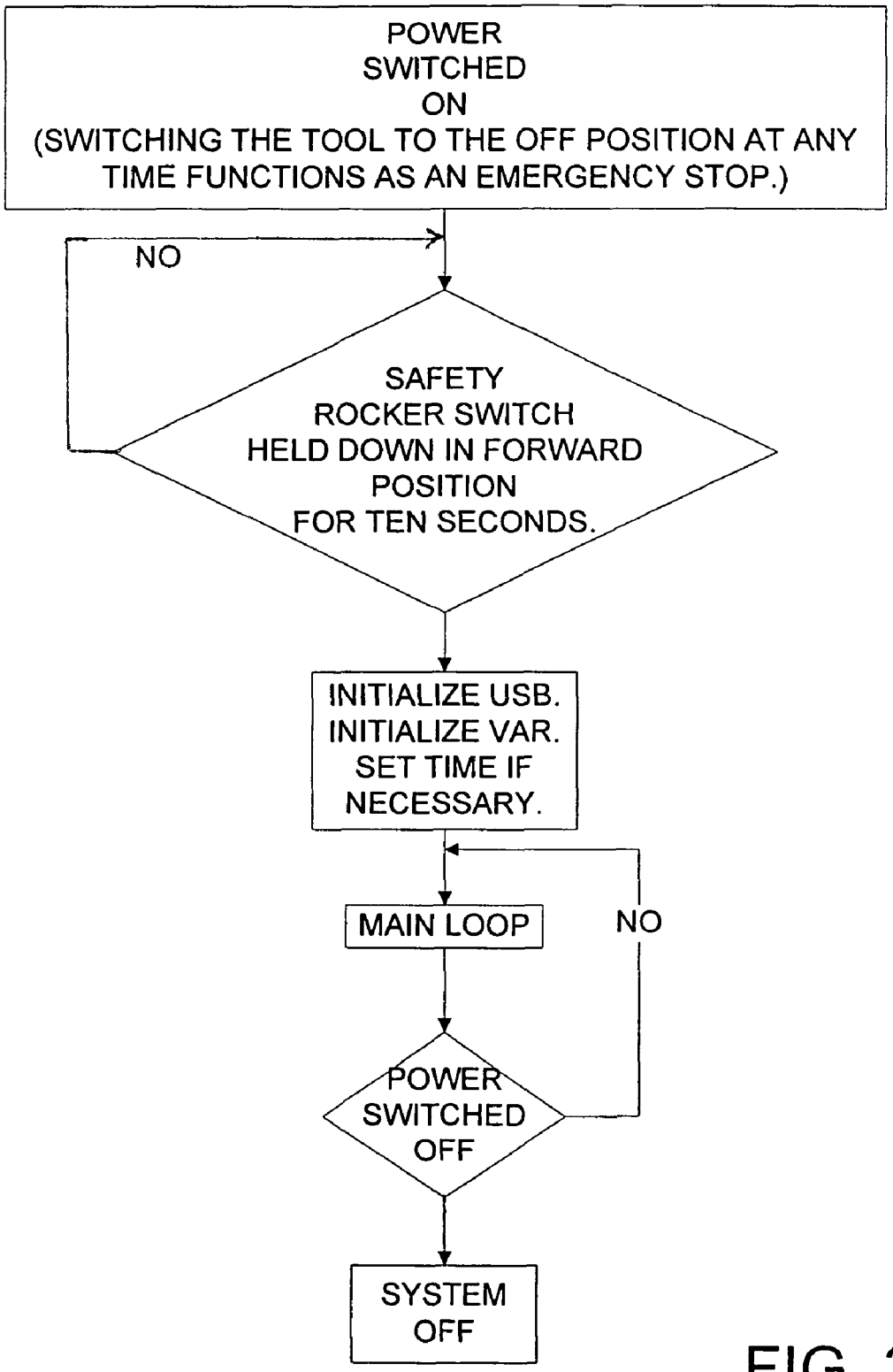
FIGS. 30 through 35 are flow diagrams illustrating programmed control of the driver of this invention including the features and adaptations shown in FIGS. 16 and 26 through 29.
Figure 31:
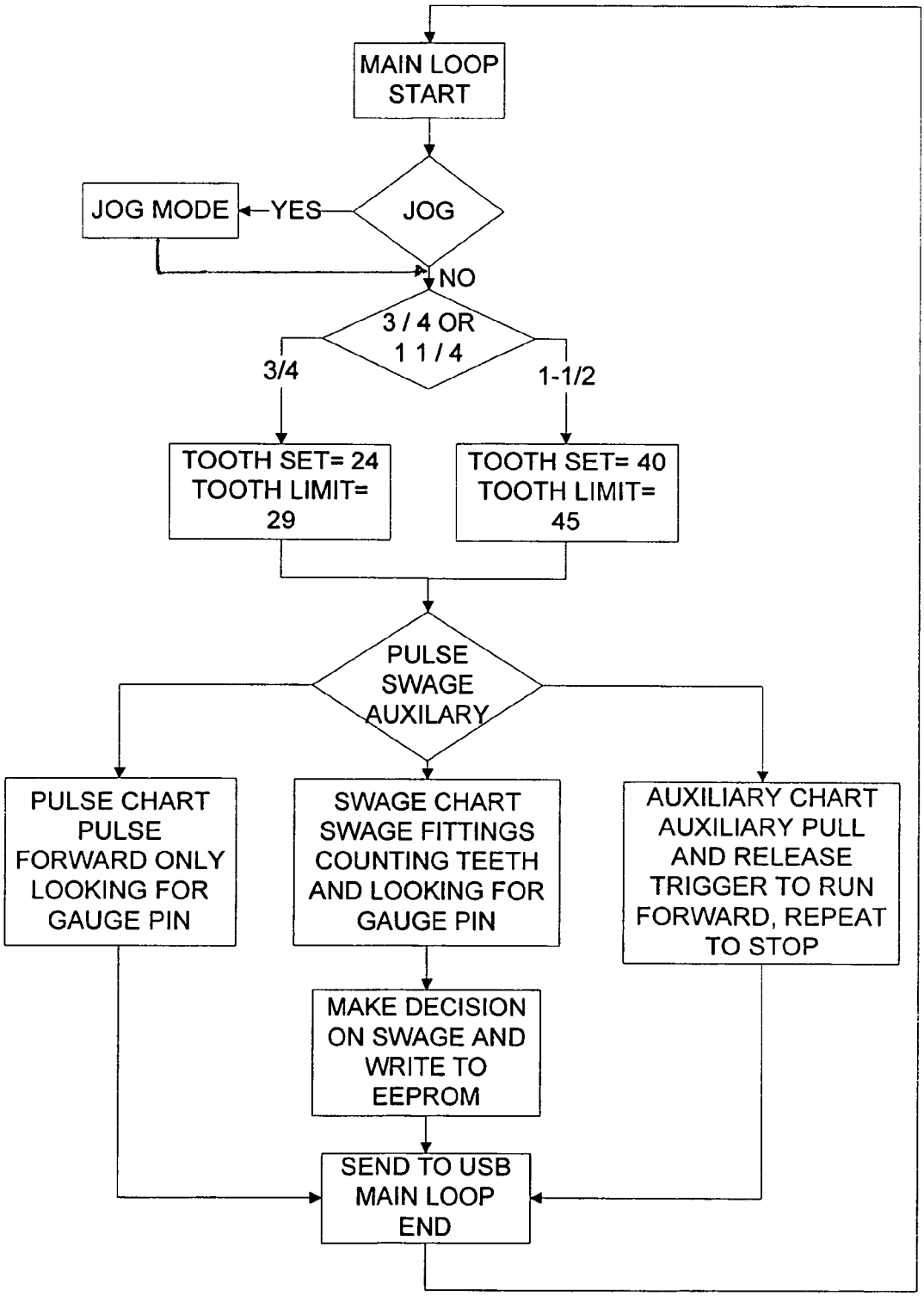
Figure 32:
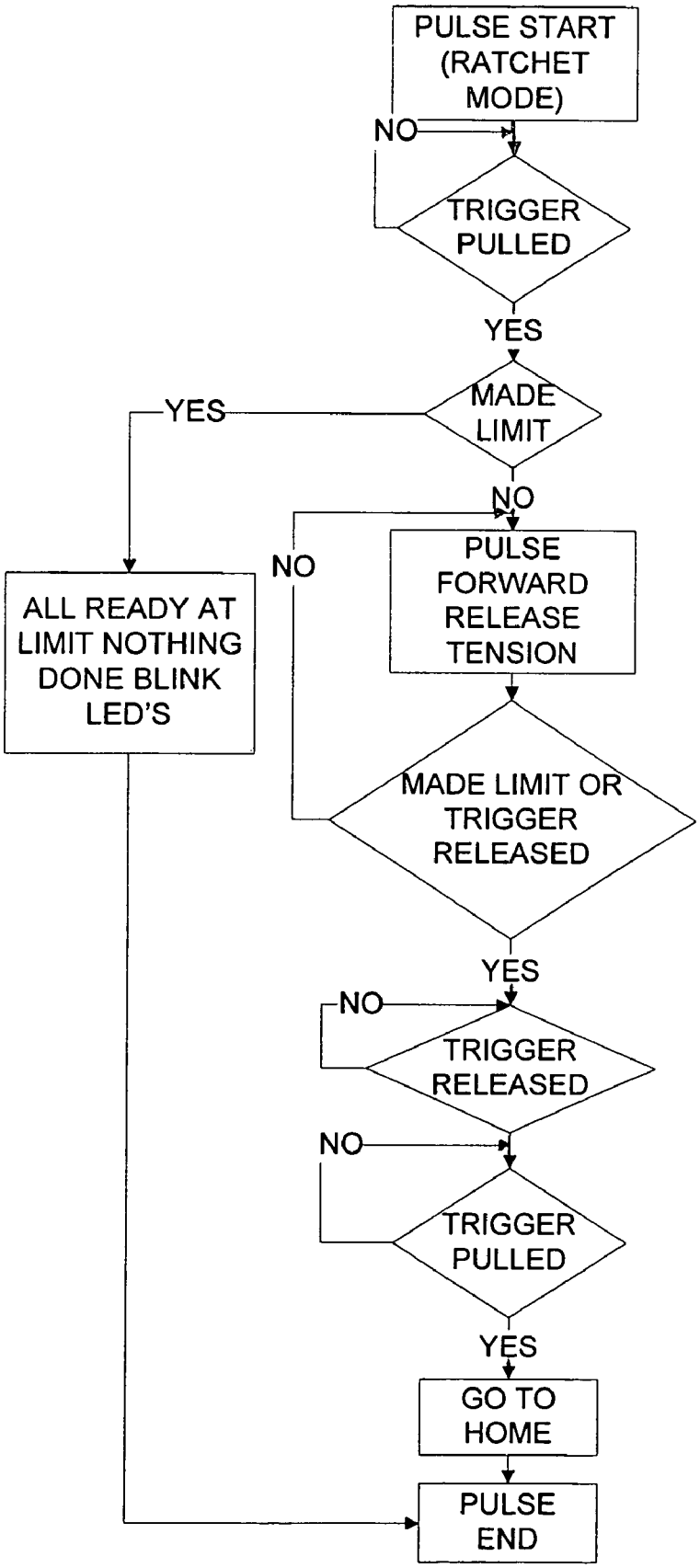

An alternative technique for gauging the relative position of the driver head/socket/nut and reaction unit/probe/connector body for indication of correct fastener tightness is shown in FIGS. 24 and 25. This embodiment replaces limit switch 187/177 with linear resistor unit 353 to regulate motor speed (to regulate nut to body gap closure speed at different stages of the traversed distance) as well as motor shut-off. Unit 353 includes housing 357 containing the resistor circuit, plunger 359, and communication port for unit connection with the circuitry of controller 265. The unit is mounted over retainers 197 and 199 using bridge 363 having unit retention pocket 365 thereat. Plunger 359 is received at guide 367 mounted over opening 185 of driver head body 83. As shown heretofore, opening 185 receives probe tip 181 (see FIG. 10) therethrough as probe 175 moves during fastener tightening. Probe movement also extends through central opening 369 of guide 367 and into contact with the plunger 359 of unit 353. In this fashion, motor control is accommodated, and proper tightness of the fastener is repeatedly achieved.

A second, and now preferred, electronic implementation of driver 21 of this invention is illustrated in FIGS. 26-29 (particularly adapted for use with embodiment 301 of the driver, though also adaptable for use with the embodiment of driver 21 shown in FIG. 1). Unchanged elements of the driver circuitry will be numbered in the drawings as heretofore identified (or will remain unidentified if not pertinent to the changes in this implementation). Main board 375 is connected directly with H-bridged circuit 255 at connector 377. Unified using connector 379 is received therein from circuit 255. Sensors connector 381 receives port connector 331 of sensor array 321. EEProm 383 stores swage fitting data collected during swaging processes as discussed hereinafter, the data used to determine, for example, when a swage is good, when a ferrule is missing, or when a fitting is already in swaged condition.

Temperature sensor 385 monitors main board temperature, and real time clock 387 is used to date/time stamp connector securement events (completed swages, for example). Sound module 389 is used to broadcast an alert to a user of error conditions encountered during operations. Switch board 391 includes the switches at array 305, among others, and operational signal lights 393 and 395. Lights 393 and 395 are bicolor LED's replacing lights 67 and 69 (at 393) and signal lights 65 and 71 (at 395). Sensor array board 321 includes sensors 333, 335 and 337, and operator monitoring LED's 397, 398 and 399 operable when the related sensor is active.

Turning now to FIGS. 30 through 35, program control techniques at controller 265 for use with the various embodiments of driver 21 (particularly embodiment 301) of this invention are illustrated. Once the driver is powered on (at switch 57), it may be used to power-off at any time. When restarting in such case, requires the safety switch to be held for a safe restart. Thereafter, various functions are initialized and the main loop is entered whereat the driver await operator input. Once awakened (FIG. 31), the control searches for jog function input, user selected rotation limitation input and/or operational mode input. The jog function mode (FIG. 35) is used for operator relocation of the socket and/or reverse rotation operations. The jog function includes a high power and lower power operational modes selectable by a user (in both forward and reverse rotation). The high power mode is used, for example, for nut tightening and nut release where greater power is required, and is essentially selected by a second trigger input after jog function mode operations are entered. The low power mode is used, for example, for fine nut/driver alignment or other low power operations. When the selected operations are completed, the main loop is again entered.

Selection of rotation limitation (FIG. 31) is directed to limiting rotation to 270° of nut/socket rotation (smaller fasteners—3/16" and smaller) or 540° of nut/socket rotation (larger fasteners—1/4" and larger). This selection in turn results in a pair of tooth count limit parameters being set (in each case), for example a tooth count threshold set point of 24 or 40 teeth (depending on limitation selected) and a tooth count limit of 29 or 45 teeth (again depending on rotation limitation selection). These counts could be more finely divided (and programmed in the field if necessary) for more precision selections availability and/or supplemented with look-up tables or the like related to particular fastener manufacturer, material, specification, tolerances and so forth to aid further precision.

Mode selection currently includes three possible selections (though more or fewer could be provided). Selection of a particular mode enters individualized process loops related to the selected mode. In pulse mode only functions related to monitored relative movement of fastener nut and body (sensor 337) are completed, and only driver events related to the same trigger driver control functions ("made limit" referred to in FIG. 32 refers to sensor 337, switch 187/177 or linear resistor unit 353 signal correspondence with probe tip 181). Auxiliary mode is a reserved functionality related solely to user operation of the driver via the run and jog switches 53 and 55 (see FIG. 34).

Figure 33:
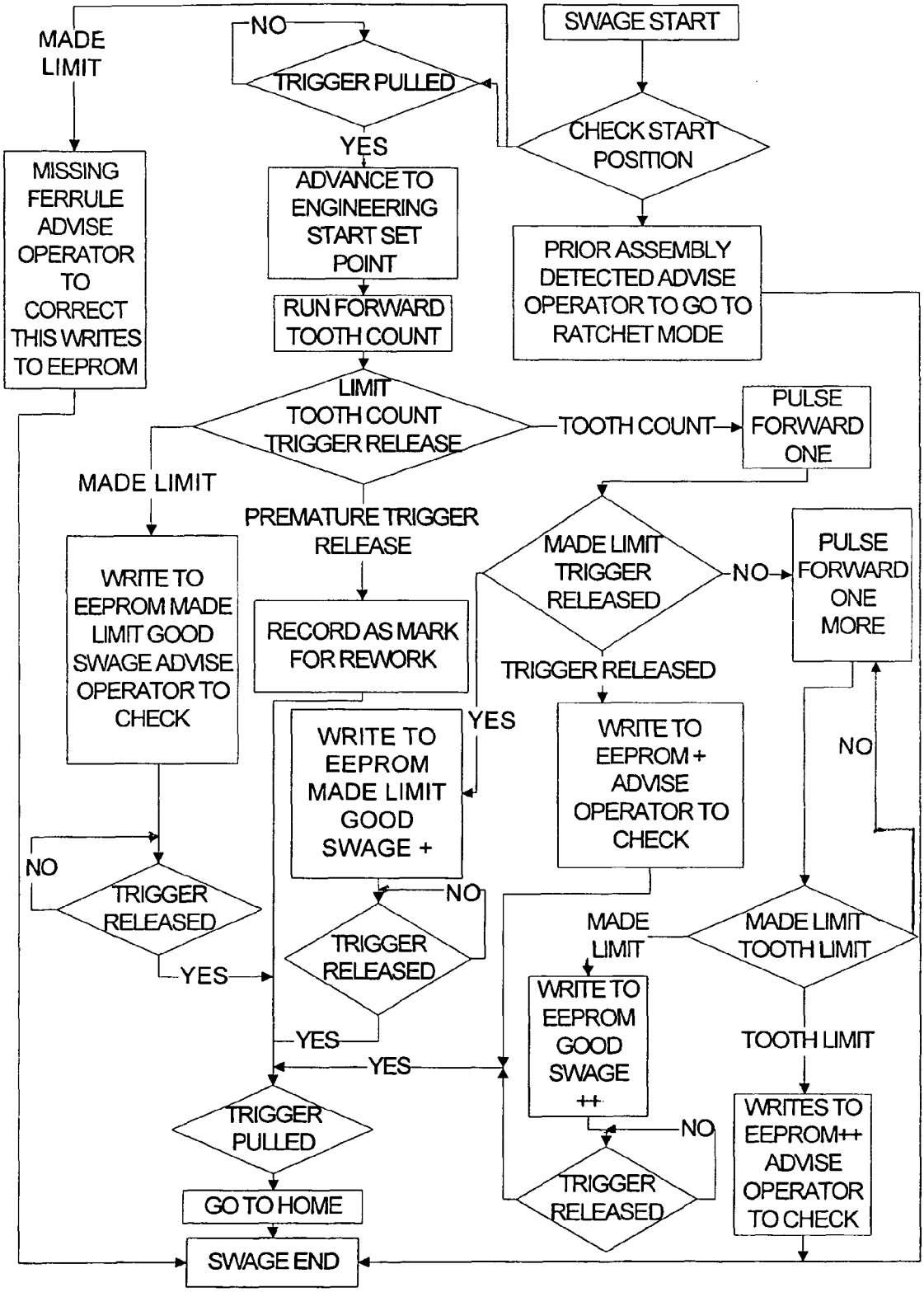
Figure 34:
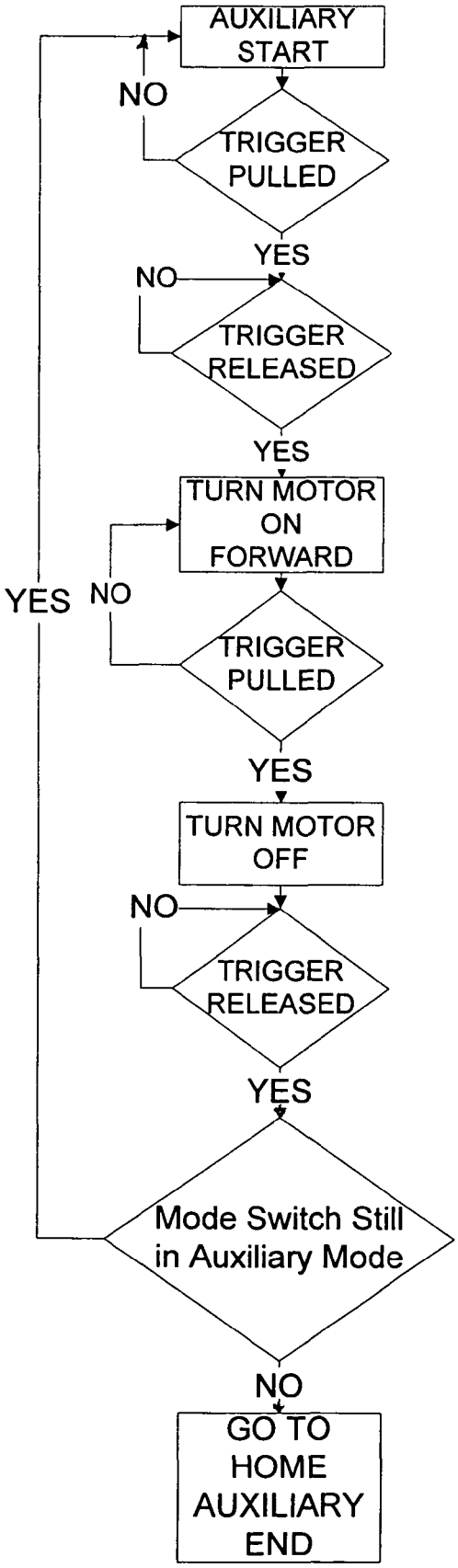
Figure 35:
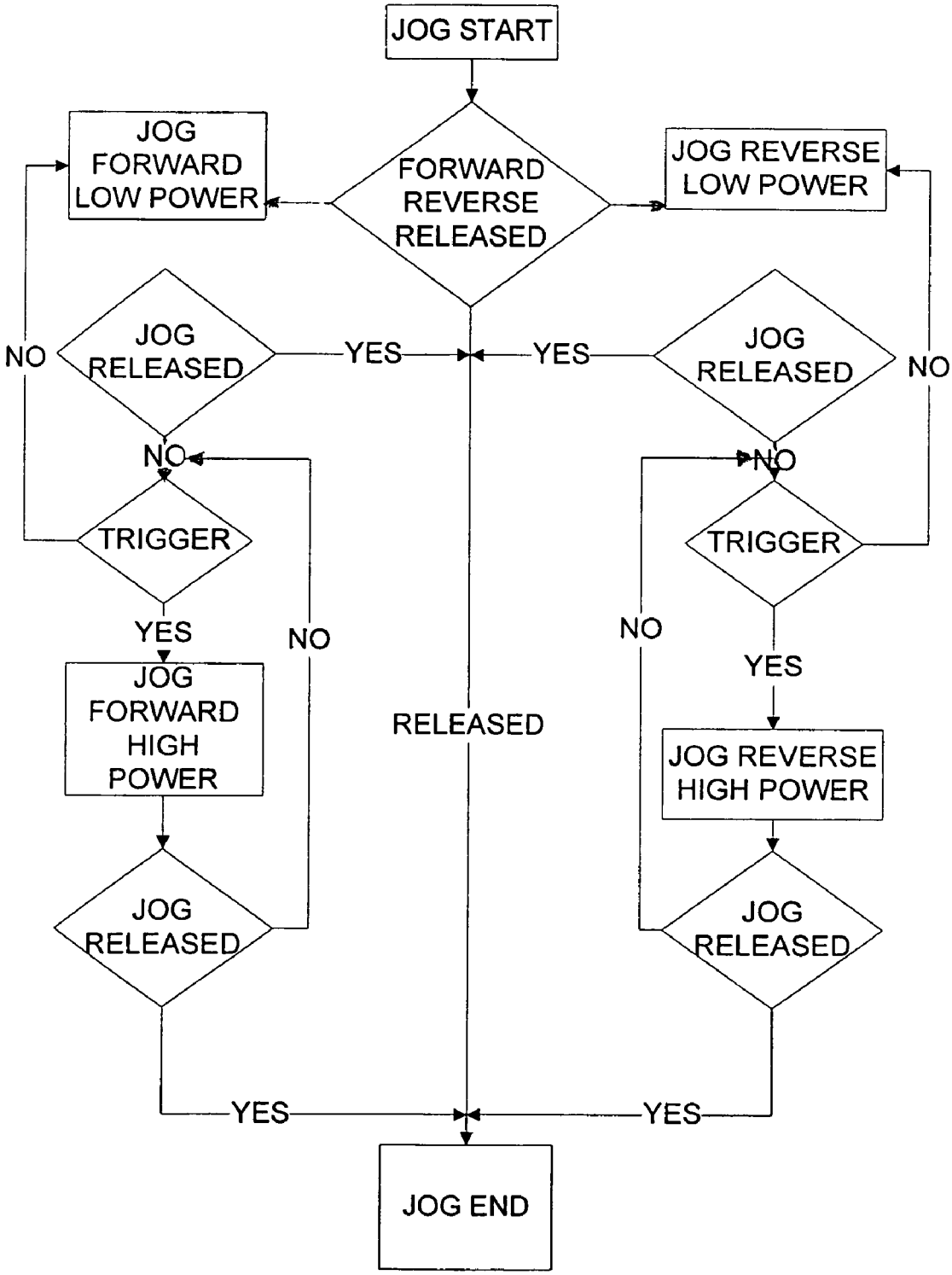

In swage mode functions related to both rotation selection (tooth counts at sensor 333) and monitored relative movement of fastener nut and body are completed, and only driver events related to the same trigger driver control functions (FIG. 33). The tooth count threshold set point parameter is utilized as a speed control mechanism to allow nut run-up. The tooth count limit is utilized along with the nut/body proximity sensed/monitored data to achieve correct fastener tightness and swage integrity and/or to note various failures or potential failures. Every swage operation and its related status is reported and saved, and various report codes are entered.

Other control options to help assure proper fastener integrity could be utilized. For example, power consumption data during a tightening operation can be monitored and reported (for example, using motor 261 current draw) and plotted versus time interval and tooth count to seek the exact point between 400° and 540° that power draw ramps up to a peak and then falls off slightly (indicating the a tube fitting ferrule has begun to yield), thereafter ramping up and peaking again (indicating full ferrule compression). This correlation is used to cease driver operation at the first peak and fall off assuring proper fitting tightness. This same data can be utilized to spot missing ferrules or otherwise defective fittings, driver malfunction (binding or the like) and operator errors.

As may be appreciated, this invention provides a highly adaptable power driver and driver control methods for precise manipulation of threaded connectors that employs various operational gauging and location specific switching to repeatably accomplish reliable and correct connector tightening thus better assuring fastener integrity.

What is claimed is:

1. A method for reliable repeated securement of threaded connectors that include a nut and a body to a correct tightness utilizing a powered driver that includes a nut engaging head and an associated connector body engaging unit, said head and engaging unit movable relative to one another, said method comprising the steps of:

setting a selected rotational limitation at the driver relating to fitting characteristics;

engaging the nut and the body of the connector at the head and engaging unit, respectively;

operating the driver to cause relative rotation of the nut and the body;

sensing said relative rotation;

monitoring sensed relative rotation for controlled indexing of the nut engaging head; and causing the driver to cease operating when an event related to either one of rotational limitation setting and driver operation occurs.

2. The method of claim 1 further comprising the steps of selecting one of a plurality of operational modes for driver operations and monitoring relative movement of the head and the engaging unit during driver operation, wherein the step of causing the driver to cease operating includes ceasing operating when a selected combination of events related to operational mode selected and at least one of rotational limitation setting, monitored relative movement and driver operation occurs.

3. The of method of claim 2 wherein the step of monitoring relative movement includes monitoring said relative movement from a location at the driver without regard to direct physical contact between the head and the engaging unit.

4. The method of claim 1 wherein the driver includes at least one gear tooth surface adapted for rotation of a socket at the head, said method further comprising the step of keeping a count of gear teeth of the gear tooth surface passing a location during a selected interval, said selected rotational limitation being calculated from said count.

5. The method of claim 4 wherein said selected rotational limitation corresponds to either 270° or 540° relative rotation of the connector nut and body.

6. The method of claim 5 wherein said selected rotational limitation includes first and second parameters related to tooth count threshold set point and tooth count limit, respectively, said method further comprising the step of utilizing both said parameters to cause driver operation and cessation to accommodate the correct tightness.

7. A driver for reliable repeated securement of threaded fittings to a correct tightness comprising:

a driver head;

a rotatable socket at said driver head for engaging the fitting;

means for rotating said socket associated with said driver head;

a reaction unit at said driver head movable relative to said socket and engageble with the fitting; and control means for user input of at least one of a selected socket rotational limitation and a selected operational mode from a plurality of modes including pulse mode and swage mode, and for precision cessation of socket rotation in accord with said user input.

8. The driver of claim 7 further comprising a non-contact sensor associated with said driver head and said control means for monitoring relative movement between said reaction unit and said socket, said control means selectively responsive to said sensor to cause cessation of socket rotation in at least one selected operational mode.

9. The driver of claim 8 wherein said means for rotating said socket includes a gear having teeth, said driver further comprising a second non-contact sensor associated with said driver head and said control means for monitoring rotation of said gear to keep a count of said teeth passing said second sensor during a selected interval, said selected socket rotational limitation being calculated from said count.

10. The driver of claim 7 further comprising a user manipulable control array adjacent to said driver head and including input switching to said control means for operational mode selection, rotation limitation selection, and power on/off selection.

11. The driver of claim 7 further comprising a linear resistor mountable adjacent to said driver head and associated with said controller, and wherein said reaction unit includes a probe mounted through said driver head and moveable thereat relative to said linear resistor, said control means selectively responsive to said linear resistor to regulate socket rotation speed and rotation cessation.

12. The driver of claim 7 wherein said means for rotating said socket includes a drive gear having teeth, said driver further comprising a hall effects sensor system including a plurality of magnets positioned at said driver and a sensor array located at said driver head and associated with said controller, said array including a first sensor for monitoring relative movement between said reaction unit and said socket, said control means selectively responsive to said first sensor to cause cessation of socket rotation in at least one selected operational mode, a second sensor for monitoring rotation of said drive gear thereby to calculate a count of said teeth during selected intervals, selected socket rotational limitation being calculated from said count, and a third sensor for monitoring driver operation indicative of rotation of said socket for controlled indexing of socket location.

13. A method for reliable repeatable gauging of correct tightness of threaded fittings that include a nut and a body secured utilizing a powered driver that includes a gear tooth surface associated with a nut engageable socket for nut rotation and movement toward the fitting body during driver operation, said method comprising the steps of:

maintaining a count of teeth of the gear tooth surface passing a location at the driver during a selected interval of operation of the driver;

gauging relative location of the socket and fitting body during movement toward the fitting body; and selectively utilizing said maintained count and said gauging to control driver operation.

14. The method of claim 13 wherein the step of maintaining a count of teeth includes non-contact sensing of rotation of the gear tooth surface.

15. The method of claim 13 wherein the step of gauging relative location includes non-contact sensing of relative movement of a reaction unit at the driver.

16. The method of claim 13 wherein the step of gauging relative location includes providing a relatively movable probe at the driver and resistance gauging at the probe.

17. The method of claim 13 further comprising the step of monitoring driver operation indicative of each full rotation of the nut at the socket and indexing socket location responsive thereto.

18. The method of claim 13 further comprising the step of gauging driver power consumption peaks and utilizing said peaks to determine at least one of correct fitting tightness, fitting defect, driver malfunction or operator error.

19. The method of claim 13 wherein said gauging occurs at the driver, said method further comprising the step of storing and reporting operational data related to said counting, said gauging and said driver operation.

20. The method of claim 13 further comprising the steps of setting and monitoring a selected rotational limitation at the driver relating to fitting characteristics, selecting an operational mode from a plurality of modes including pulse mode, swage mode, and jog mode, and differentiating control based on operational mode selection.

21. The method of claim 20 wherein selecting said jog mode includes the steps of selecting rotational direction and rotational power from plural available direction selections and plural available power selections, and differentiating control based on operational mode selection.

* * * * *